US006662574B2

(12) United States Patent
Loibl et al.

(10) Patent No.: US 6,662,574 B2
(45) Date of Patent: Dec. 16, 2003

(54) RAPID FLUID COOLING AND HEATING DEVICE AND METHOD

(75) Inventors: Gregory H. Loibl, Salt Point, NY (US); George Sidebotham, Brooklyn, NY (US)

(73) Assignee: The Cooper Union for the Advancement of Science & Art, New York, NY (US)

( * ) Notice: Subject to any disclaimer, the term of this patent is extended or adjusted under 35 U.S.C. 154(b) by 0 days.

(21) Appl. No.: 10/086,285

(22) Filed: Mar. 1, 2002

(65) Prior Publication Data

US 2002/0124576 A1 Sep. 12, 2002

Related U.S. Application Data

(60) Provisional application No. 60/272,510, filed on Mar. 1, 2001.

(51) Int. Cl.[7] ..... F25D 17/02
(52) U.S. Cl. ..... 62/64
(58) Field of Search ..... 62/62, 64, 74, 62/375, 381

(56) References Cited

U.S. PATENT DOCUMENTS

| | | | | |
|---|---|---|---|---|
| 2,794,326 A | | 6/1957 | Mencacci | |
| 3,083,547 A | | 4/1963 | Stevens et al. | |
| 3,283,523 A | | 11/1966 | Long | |
| 3,316,734 A | | 5/1967 | Crane, Jr. | |
| 4,139,992 A | | 2/1979 | Fraser | |
| 4,164,851 A | * | 8/1979 | Bryant | 62/381 |
| 4,304,105 A | | 12/1981 | West | |
| 4,531,382 A | | 7/1985 | Butler et al. | |
| 4,549,409 A | * | 10/1985 | Smith | 62/381 |
| 4,580,405 A | | 4/1986 | Cretzmeyer, III | |
| 4,628,703 A | | 12/1986 | Kim | |
| 4,711,099 A | | 12/1987 | Polan et al. | |
| 4,736,593 A | | 4/1988 | Williams | |
| 4,803,850 A | | 2/1989 | Josten et al. | |
| 4,813,243 A | | 3/1989 | Woods et al. | |
| 4,825,665 A | | 5/1989 | Micallef | |
| 5,505,054 A | * | 4/1996 | Loibl et al. | 62/63 |

* cited by examiner

*Primary Examiner*—Henry Bennett
*Assistant Examiner*—Malik N. Drake
(74) *Attorney, Agent, or Firm*—Levisohn, Berger & Langsam LLP; Barry E. Negrin

(57) ABSTRACT

A method and device for rapidly changing at least one of the temperature and the state of a liquid in a container is provided. The container is rapidly rotated about its longitudinal axis. A source of a thin film of a medium having a different temperature than the liquid in the container is provided to thermally affect the container while rotating the container. The container is positioned at an angle to the horizontal of less than 45°, and the position of the container with respect to the thin film source is controlled by angling the axis of the container skewed from the axis of the rotating mechanism. The device can be used to cool liquids such as beverages, warm liquids such as infant formula, and/or make ice cream.

122 Claims, 13 Drawing Sheets

RAPID FLUID COOLING AND HEATING DEVICE AND METHOD

RELATED APPLICATIONS

This application claims domestic priority from U.S. Provisional patent application Ser. No. 60/272,510 filed Mar. 1, 2001 and incorporates by reference all of the teachings therein.

BACKGROUND OF THE INVENTION

1. Field of the Invention

This invention relates to methods and devices for use in the rapid cooling and heating of fluids in various containers of differing geometry.

2. Description of the Related Art

Various devices and methods have been employed in cooling beverages or fluids in containers from room temperature to consumption-pleasing low temperatures, generally of about 5° C. The most common method is the use of commercial or household refrigerators or freezer units into which the beverage containers are statically placed. Air inside the conventional refrigerator or freezer is cooled, and the air cools the beverages or fluids. While effective, such cooling means entails the utilization of massive refrigerator and freezer space (especially in commercial establishments) which is costly and is at a premium, particularly when freezer or refrigerator space is generally required for other food storage purposes.

In addition to occupying a lot of space, these conventional refrigeration and freezer units require inordinate initial periods of time to cool a liquid such as a beverage, for example, from room temperature (20°–25° C.) to the desired 5° C., approximately an hour to several hours. If reasonably immediate consumption is required, such as at point of sale, at parties, or on very hot days, this time delay for cooling is unacceptable. Also, many individuals prefer beverages at temperatures colder than a conventional refrigerator can provide, e.g., 1–2° C.

Accordingly, quick cooling devices have been developed specifically for use with beverage containers. Some of these devices, while generally effective in reducing the time for cooling beverages, nevertheless still require a minimum of about five minutes for the cooling of a standard 12 oz beverage can, still an inordinate amount of waiting time for a customer; this cooling lag time increases for larger containers, such as 16 oz or 20 oz soda or beer bottles and roughly 25 oz wine bottles.

Existing cooling devices operate on one of two general methods involving heat transfer. A first method, and the most common one, involves cooling with ice such as embodied in a commercial device known as the Chill Wizzard and as described in U.S. Pat. No. 4,580,405 to Cretemeyer, III. This device provides for placement of a beverage can on a bed of ice to effect heat transfer and cooling. Since only a portion of the container is in contact with the ice, the container is rotated against the ice. In order to rotate the device, a suction cup connected to the spindle of a motor is attached to the bottom of the can. In addition, in order to maintain heat transfer-contact with the ice, the device provides for a constant mechanically-exerted contact pressure of the container against the ice to compensate for the melting and consequent reduction of height of the ice. Since ice can have substantially lower temperatures than the desired drinking temperature, heat exchange and beverage temperature lowering is facilitated and hastened. However, the Chill Wizzard device can only chill 12 oz cans and is unable to accommodate a variety of different-sized or -shaped containers. Further problems with this method are discussed below.

A second, less effective method involves conveying or placing the beverage containers into a cold water or bath. Because the container is stationary, cooling times for this method have been substantially longer than that for methods which utilize horizontal rotation of the container. This is also true because the water is stationary as well.

Another commercial device is the Vin Chilla, a bucket-shaped device for cooling wine bottles. A bottle is placed upright in the bucket and ice and water are added thereto. The device swirls the water around the bottle. Although the Vin Chilla commercial literature claims it can chill wine to a drinkable temperature in about 4 minutes, this period is only valid for cooling red wines, which are to be consumed at only 1–2 degrees below room temperature. A white wine requires up to 20 minutes of cooling to be brought to a desirable temperature, e.g., 5° C.

Despite its effectiveness in cooling (because of its low temperatures relative to water), the use of ice as a direct cooling medium can however be detrimental in certain common uses. When used for cooling carbonated beverages, particularly when such cooling is not carefully monitored, freezing of the beverage, with untoward consequences, is possible. Moreover, the temperature of ice is rarely at 0° C. and is usually significantly lower. As a result, if the ice temperature is sufficiently low, freezing of the beverage within the container is possible, especially with extended cooling times. Since such containers are closed, it is difficult if not impossible to monitor temperature and phase conditions of the beverage during the cooling process to stop the process prior to any freezing. Under these conditions, with excessive cooling, partially frozen carbonated beverages will erupt when the container is opened. Though cold water is not subject to this detrimental effect with carbonated beverages, its use is however not as efficient in effecting the requisite rapid cooling.

In addition, none of the prior art devices discussed above can be used without major modification for other purposes, such as warming a beverage such as infant formula or making ice cream.

One major improvement in this field of endeavor is described in U.S. Pat. No. 5,505,054 to Loibl et al., the same inventors as the instant inventors and which patent is assigned to the same entity to which the instant invention is assigned. Loibl et al. teach an extremely rapid method and device for cooling beverages. One or more beverage containers are rapidly rotated substantially along their respective longitudinal axes while being downwardly sprayed with a cooling water spray, with the water being recycled from a 0° C. ice water bath. The volumetric rate of the water in the water spray is sufficient to form a continuous coating on the rotating container. Rotation of the containers is effected in a horizontal direction, with the containers being nested between adjacent rotating rollers and rotated with a speed of between 200–500 rpm. Standard 12 oz. beverage cans can be cooled thereby from room temperature to a drinking temperature of 5° C. in under one minute. The teachings of the Loibl patent are herein incorporated by reference, particularly col. 2, line 55-col. 5, line 58.

Yet the teachings of Loibl et al. in the '054 patent do not expressly address the need to accommodate a variety of different-sized and shaped containers. Further, the prior Loibl device, while extremely effective, incorporates a number of spray jets positioned in various locations above the rotating containers and a number of rollers positioned below the containers. It is desirable to simplify this design. Also, since the average beverage consumer is not necessarily a technician, it is desirable to make the use of such a device as simple as possible, with respect to container placement within the device, among other things.

Moreover, it is desired to be able to use the basic principles of Loibl '054 to increase the temperature of certain fluids and beverages, e.g., infant formula or milk. A current method involves placing a baby bottle in a pot of water on a stove and heating the water. Heating a baby bottle in this manner can cause the contents of the bottle to become extremely hot to the point of being dangerous.

SUMMARY OF THE INVENTION

It is an object of the present invention to provide a means for the very rapid cooling and heating of liquids such as beverages within containers, with a time period of cooling which is significantly shorter than that of prior art devices which utilize cooling with ice.

It is another object of the present invention to provide a rapid cooling and heating device which is safe, easily manufactured, and appropriate for a fairly unsophisticated consumer/retail market.

It is another object of the present invention to provide a rapid cooling device without the detriment of possible freezing of carbonated beverages.

It is another object of the invention to provide a single, simple-to-use control system for either cooling or heating a beverage or other fluid within a container.

It is another object of the invention to provide a rapid cooling device that can accommodate containers of differing sizes, shapes, and materials.

It is another object of the invention to provide a rapid cooling device that can change the state of the contents of a container.

The above and other objects are fulfilled by the invention, which is a method and device for rapidly cooling or heating fluids held in containers. The inventive method of rapidly changing at least one of the temperature and the state of a liquid in a container includes the steps of rapidly rotating the container about its longitudinal axis and providing a source of a thin film of a medium having a different temperature than the liquid in the container to thermally affect the container while rotating the container. The container is positioned at an angle to the horizontal of less than 45°, and the position of the container is passively with respect to the thin film source. The medium may be either a liquid or a gas. The provision of a thin film may preferably be accomplished by spraying the container with the medium from a spray source. As an alternative, in the case where it is desired to cool the contents of the container, ice may be employed above the container which melts to thereby provide the thin film of cooling medium (i.e., ice-cold water) which covers a substantial portion of the container by gravity and rotational forces.

The container may be shielded from direct physical contact with the medium by providing a covering around the container in thermal communication with the container. Preferably, the thermal effects of the medium pass through the covering and change at least one of the temperature and the state of a liquid in a container. The passive positioning of the container may preferably include angling the container at an angle from the rotational axis of the rotating mechanism so as to urge the container to move along the rotating mechanism via relative corkscrew application of force by the rotating mechanism.

The inventive method preferably includes a number of features to accommodate a variety of different containers. For example, the rotation of the container may be selectively disabled to accommodate containers that may not rotate conveniently (e.g., containers with non-round cross-sections, containers with corners, irregular-shaped containers, etc.). The inventive method may also preferably include providing a housing having a hole or cut-out portion to accommodate containers of varying sizes (i.e., some containers would be placed inside the housing but project from the hole).

The inventive method may further preferably include specific methods of cooling liquids in containers (such as beverages), warming liquids in containers (such as infant formula or milk in a baby bottle), and making ice cream.

The invention also includes a device for performing the above-described method. The device includes a housing having a bottom and side walls defining an interior volume. In one embodiment, the housing is a portion of a refrigerator, e.g., the door. A rotating mechanism having a longitudinal axis is disposed in the housing for rotating a container about the container's longitudinal axis. A lateral positioner is disposed at an angle to the longitudinal axis in the housing adapted to position the container at an angle to the rotating mechanism. The device includes a source of a thin film of a medium having a first temperature different from a second temperature of the liquid inside the container to thermally affect the container. As mentioned above, the source of the thin film may be a spray jet spraying the medium towards the container, or it may include at least one piece of ice disposed above the container in contact with the container. In the latter version, as the ice melts, the ice creates a thin film of cold water which cools the container.

In the former spray jet version, the device preferably includes a reservoir in the interior volume adapted to contain a quantity of the medium and a pump in communication with the reservoir and the spray jet. The pump draws the medium from the reservoir and pumps it to the spray jet. The lateral positioner causes the container to move towards the spray jet when the rotating mechanism is rotating.

The device may preferably include an active heating or cooling unit in communication with the reservoir to maintain the temperature of the medium in the reservoir. In one embodiment, that function is accomplished by a Peltier device in thermal communication with the reservoir. When the apparatus is being used to cool the liquid, the Peltier device cools the device warms the medium in the reservoir. The great versatility of the Peltier device is achieved simply by reversing the direction of the flow of current through the Peltier device. That is, when the current flows in one direction, one side is cold and the other is hot. When the current flows in the opposite direction, the first side is hot while the second side is cold.

A covering may be provided removably disposable around the container in thermal communication with the container shielding the container from direct contact with the medium. The thermal effects of the medium pass through the covering and change at least one of the temperature and the state of the liquid in the container.

In one embodiment, the lateral positioner includes a plurality of ribs that project from at least one of the side walls, and may be provided from more than one side wall. The rotating means is preferably a single roller preferably having raised contact portions, such as rubber contact rings, for example, which contact the container only at discrete points along the length of the roller/can interface. The roller and ribs may support the container above the reservoir, either out of contact with the reservoir or partially submerged in the reservoir. In the preferred embodiment, the roller supports the container from underneath and the ribs (or side wall) support the container on the side.

Preferably, the ribs vary in width (the dimension orthogonal to the side wall from which they project); specifically, the profile of the ribs is skew-angled with respect to the roller. This angling of the profile of the ribs forces the container to be angled with respect to the roller, which causes the container to move longitudinally as it is rotated, a feature which will be explained below.

A water jet of sufficient volumetric flow rate will tend to spread over the entire surface of the container even if it is limited to a small initial area of impingement on the container. Thus, water jet dispensing means, such as a shower head or spray jet is effectively provided directly above a portion of the container. The provision of the aforementioned contact rings on the roller enables the water to coat a greater surface area of the container than would be possible with a solid roller; i.e., the sprayed water clings to the container around the entire surface of the container—even the bottom-most portion—except where the contact rings engage the container. The contact rings also create much better frictional contact with the container than a simple solid roller and prevent hydroplaning of the container on the roller during rotation. Because of the angling of the profile of the ribs, the container moves closer to the rear of the housing towards the spray jet. The advantage is that the need for a number of spray jets is reduced, because the container is consistently and repeatably positioned within the cooling unit so that a single spray jet can cover the entire surface of the container.

The housing is also preferably provided with a cut-out portion formed in a front end of the housing. The cut-out is provided to accommodate containers having long necks that may exceed the dimensions of the cooling unit. In this way, containers such as wine or beer bottles may be rapidly chilled by a device that need not be as large as to enclose an entire wine bottle. Manufacturing materials are saved, and costs are thus reduced. Moreover, the size of the device is reduced, thereby conserving kitchen counter space in a domestic setting. The provision of a cut-out further emphasizes the importance of angling the ribs to control the positioning of the container with respect to the spray jet. A splash guard may be removably provided to cover the cut-out portion so as to reduce the amount of the medium that exits the housing during operation.

Optionally, the device includes timing means for showering the containers for a predetermined time sufficient to effect the requisite cooling or warming. The device may be preprogrammed with a set number of different timing sequences and/or rotational speeds depending on the type of container, the type of liquid/beverage, and the desired temperature of the liquid. The device may include a means for continuing the sequence beyond the predetermined period of time if the user wishes to provide extra cooling or warming for the liquid. Temperature sensors may be provided to monitor the reservoir, the liquid in the container, or both. The container sensors may be contact sensors, infrared sensors, or the like.

DETAILED DESCRIPTION OF THE PREFERRED EMBODIMENTS

Detailed description of the invention will now be provided with reference to FIGS. 1–14. It should be understood that these drawings and this detailed description are exemplary in nature only, and do not serve to limit the scope of the invention, which is defined by the claims appearing hereinbelow.

Figure 1A:
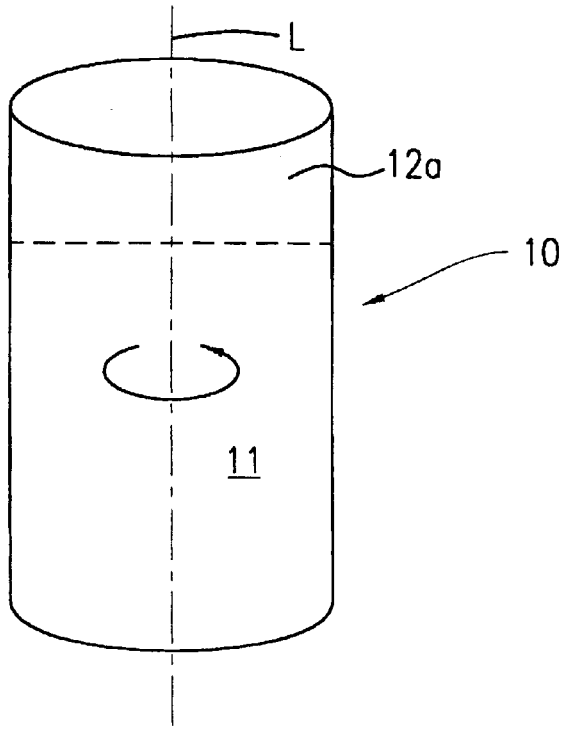
FIGS. 1A and 1B depict a standard beverage container in the upright and horizontal positions, showing the liquid contents level therein in dotted lines.
Figure 1B:
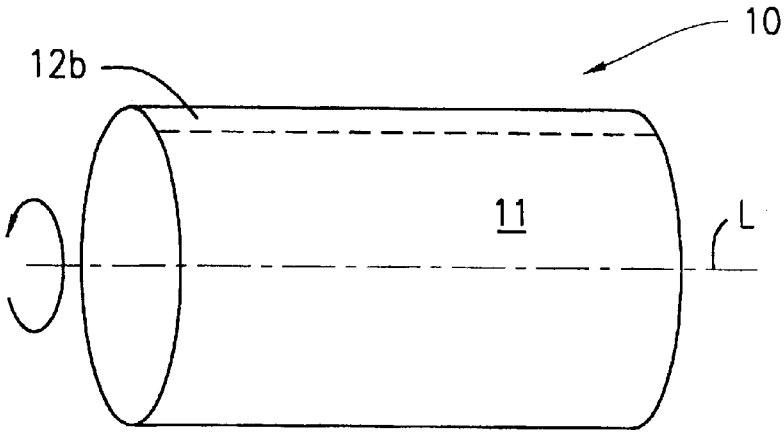
Figure 2:
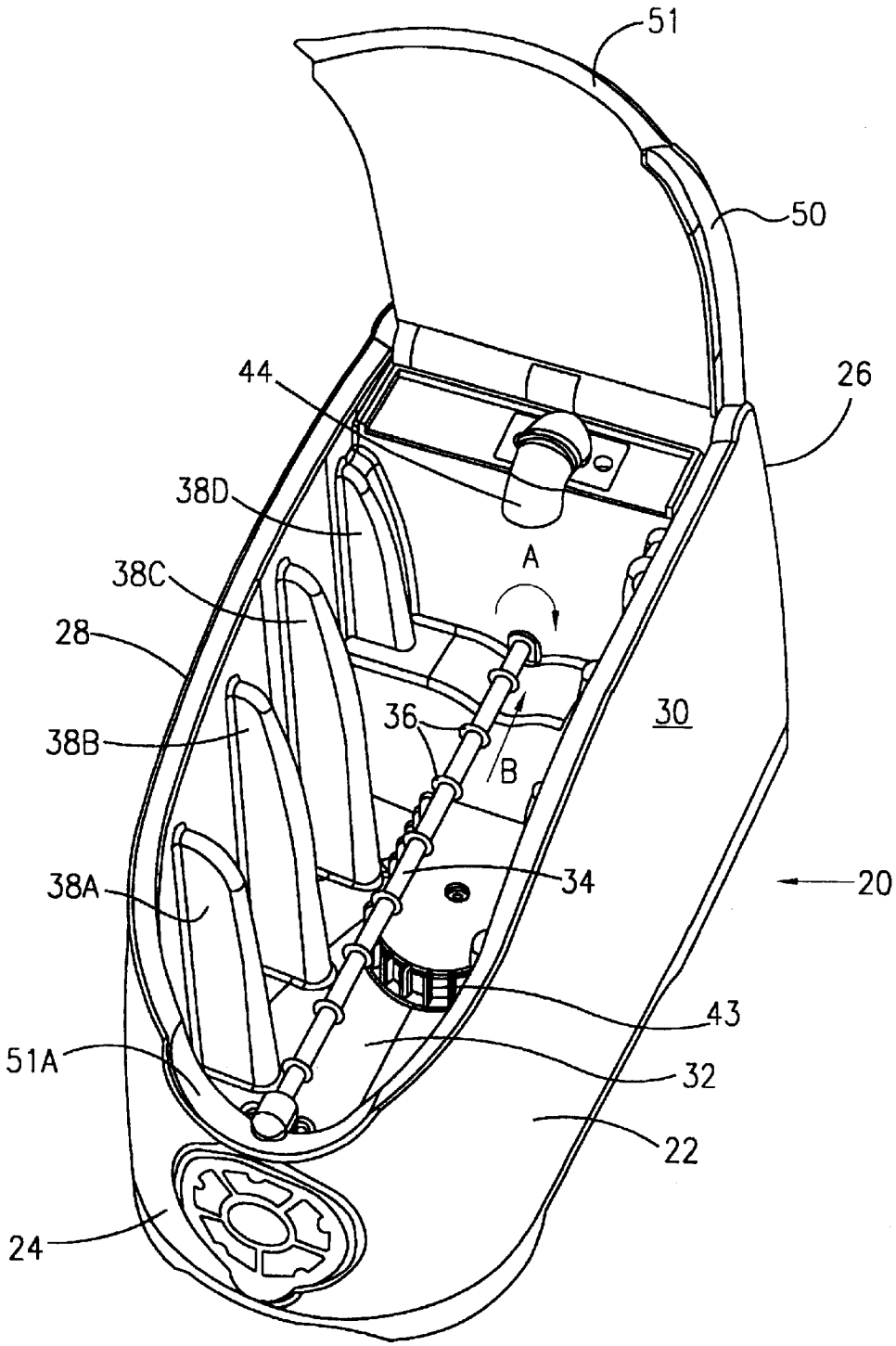
FIG. 2 is a top perspective view of a first embodiment of the cooling device of the present invention.

FIGS. 1A and 1B depict a typical 12 ounce beverage container 10 positioned vertically and horizontally respectively. The beverage 11, contained therein is shown with an air space 12A in FIG. 1A and a full can length air space 12B in FIG. 1A. Rotation of the container along its longitudinal axis L, when the container is positioned vertically, results in a rotation of an essentially rigid body with little mixing and extensive cooling times being required. By contrast, the horizontally disposed container 10 in FIG. 1B, when rotated about its longitudinal axis L, results in a high degree of agitation with a high degree of mixing and exchange heat transfer rates.

Figure 14:
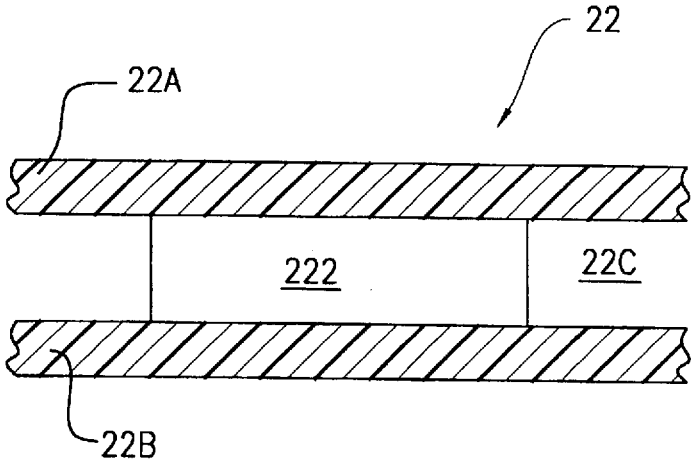
FIG. 14 is a broken side sectional view of a preferred cooling element of the invention.

FIGS. 2–7 depict a preferred embodiment of the invention. Cooling unit 20 has a housing 22 which includes a front end 24 and a rear end 26 as well as left and right side walls 28 and 30, respectively. It should be understood that any shape may be employed for the housing of cooling unit 20. The side walls and the bottom define an interior volume or reservoir 32 into which an ice water solution is disposed. The housing is preferably made of plastic, however any material can be used. The side walls 28 and 30 and bottom of housing 22 are preferably double-walled, i.e., they have a layer of insulation such as air disposed between two layers of housing material. As shown in FIG. 14, for example, housing 22 may include inner wall 22A and outer wall 22B with insulative layer 22C (e.g., air, foam, etc.) therebetween. The air layer serves two insulative functions. First, by insulating the exterior from the ice-cold ice water reservoir, a layer of condensation ("sweat") will not form on the exterior of housing 22, an otherwise undesirable occurrence. Second, by insulating the interior from the outside ambient air (which is presumably at room temperature or approximately 25° C.), the ice water reservoir 32 remains colder longer because it is absorbing less heat from the environment. Air is an excellent insulator, however other insulation materials may be employed instead of or in addition to air.

Leaving a gap between the two layers of housing material also enables active control of the temperature of the reservoir in that cooling elements may be disposed between the layers in the bottom and/or sidewalls of housing 22. For example, such cooling elements may include standard refrigeration coils. A preferred embodiment is shown in FIG. 14. Cooling element 222 is disposed between walls 22A and B in thermal communication with reservoir 32. The preferred embodiment of element 222 is a thermoelectric module or Peltier device, a module typically comprised of two ceramic substrates that serve as foundations and insulation for components connected electrically in series and thermally in parallel between the substrates. If current is applied to a Peltier device in one direction, one side of the device becomes hot while the other side becomes cold. If current is applied in the other direction, the heat flow is reversed. Thus, current can be applied in one direction to keep the cooling medium in reservoir 32 cold while pumping heat out of the cooling unit (e.g., from the bottom of housing 22). If the current is reversed, heat can be pumped into reservoir 32 for use in heating or warming liquids, as will be discussed below. The invention contemplates using any form of thermoelectric module as a cooling element 222.

A container such as soda can 10 is intended to be placed within housing 22; depending on the relative height of the support structure upon which the container rests, the container may not be in direct contact with the ice water solution disposed in reservoir 32, or it may be partially submerged in reservoir 32. A drive roller 34 is provided on which the container is to be placed. The drive roller 34 preferably includes several spaced apart contact rings 36 upon which the container is intended to be supported. As mentioned above, contact rings 36 provide for better frictional contact between roller 34 and container 10 than a simple smooth roller would provide, because the same weight of the container is contacting a much smaller surface area (i.e., the ring-container interface is significantly smaller than a smooth roller-container interface). The contact rings also allow water that is sprayed onto the container for cooling (see below) to wrap fully around the container and thus contact a greater surface area of the container, thereby maximizing heat transfer. Further, the gaps between adjacent contact rings provide channels into which water may fall off of the container back into reservoir 32; this channeling effect helps to prevent hydroplaning of the container on the roller, which would otherwise be caused by a thin layer of water getting trapped between the container and a smooth roller. Of course, a roller of uniform profile may also be employed without departing from the invention. It would be desirable to create good frictional contact between the roller and the container in any event.

Since roller 34 is circular in section and the majority of beverage containers are also circular in section, single roller 34 by itself provides insufficient support for a typical container, particularly since roller 34 will be rotating and causing can 10 to rotate. Thus, a plurality of ribs 38 are formed in one or both of the side walls to provide lateral support for a container to be placed within cooling unit 20. That is, when a container is placed therein, it is supported on the bottom by roller 34 and on the side by ribs 38. Ribs 38 are preferably spaced apart to enable a person to get his/her fingers around the container more easily when removing the container after chilling, and strengthen the wall upon which they are provided.

The ribs also facilitate the addition of ice into reservoir 32 by providing additional clearance between roller 34 and wall 30. Were the ribs not provided, wall 38 would need to be moved to where the innermost portions of ribs 38 are, i.e., inwardly closer to the roller, thereby reducing the sectional area through which ice may be added to the reservoir. As with the contact rings 36, ribs 38 also allow water to flow smoothly entirely around container 10; if a smooth wall were provided, the water sprayed on top of the container would flow to the wall/container interface and stop. The ribs allow the water to flow smoothly around the bottom of the container and then neatly collect back in the reservoir. Ribs 38 are preferred but not required; a flat or curved wall or additional roller(s) could be used to provide support for the container as well. Further, additional support structure may be provided to secure the container and prevent it from falling into the reservoir; for example, a clamp or netting may be provided which keeps the container in contact with roller 34 may be provided in the interior volume of the housing, either attached to a side wall or from the underside of lid 50, for example.

Figure 5B:
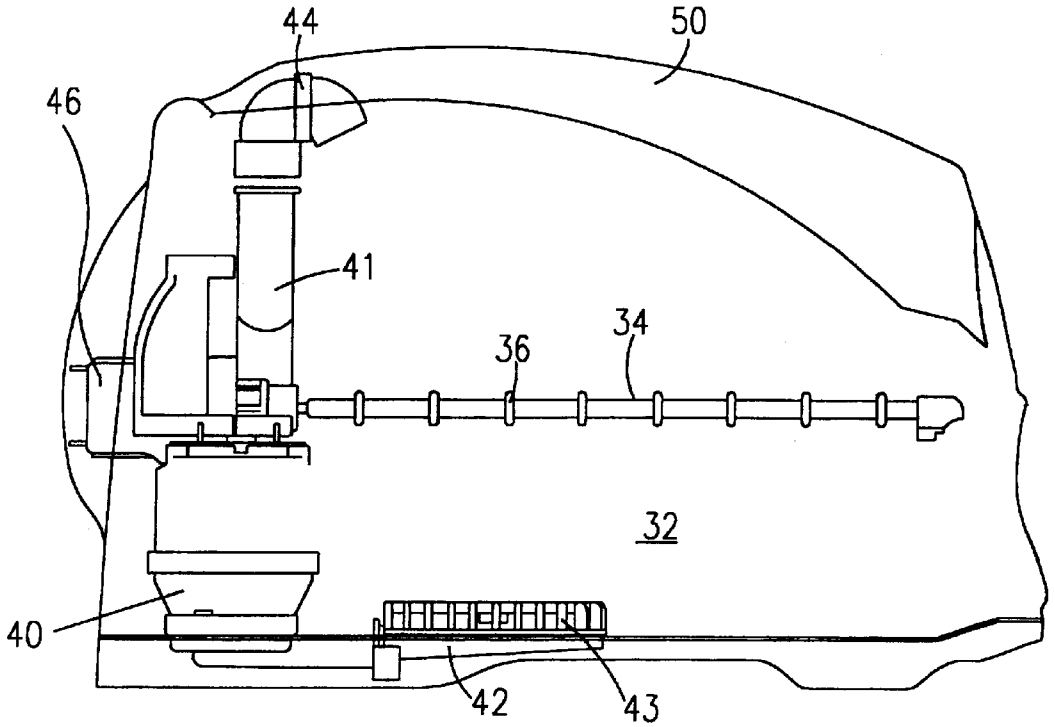
FIGS. 5A–B are rear and side cutaway schematics showing the interior of the embodiment of FIG. 2.

As shown in FIG. 5, a pump 40 is preferably provided, powered by power supply (not shown), to send water from the ice water reservoir 32 up through tubing or piping 41 to spray jet or nozzle 44. The floor of housing 22 is preferably angled to cause water in reservoir 32 to collect or pool nearest the pump inlet. In this way, the amount of water required to run the cooling cycle is minimized, thereby allowing a maximum amount of ice to be employed to maximize the amount of heat the ice-water solution can absorb. A grill 43 is provided in front of the intake 42 of pump 40 to minimize air bubbles being pulled into the pump.

Spray jet 44 is designed to shower the circumferential surface of a container placed in the cooling unit with ice-cold water so as to cool the contents of the container. Optionally, an additional spray jet may be provided to coat the bottom surface of a container with a separate jet spray. It is preferred to provide a single spray jet for each surface of the container so that the film of water sprayed onto a given surface of the container is smooth and clings to the container; the provision of multiple spray jets for a given surface (i.e., a number of spray jets positioned above the circumferential surface of the container) is not preferred, because the respective jets of water interfere with each other and prevent a smooth film of water from forming over the entire container. A container must therefore be placed within the cooling unit so that the sprayed water from spray jet 44 will substantially contact the container. In the preferred embodiment shown, since spray jet 44 is only provided in the rear of the cooling unit 20, the proper placement of the container is extremely important.

Accordingly, ribs 38 are not preferably provided as being identical. Rather, the distance from the drive roller to the outer edge of the ribs 38 preferably varies from front to back; that is, front-most rib 38A is the closest to the roller 34, rib 38B is further than rib 38A, rib 38C is further than rib 38B, and rib 38D is further than rib 38C. An example of the dimensioning of the ribs is shown in FIGS. 7A–D, where ribs 38A–D are left-side ribs and ribs 38A'–D' are right side ribs. As a result, the profile or outer extent of the ribs is not parallel to roller 34 but rather skewed at an angle α from parallel to the roller. The angling of the profile of ribs 38 causes the container placed in the cooling unit to be angled with respect to roller 34. As such, the roller 34 causes a corkscrew-like rotation in the container with respect to the roller, and container will travel in the longitudinal direction. If the container is made to rotate as shown by arrow A in FIG. 2, the corkscrew motion will cause the container to travel in the direction of arrow B, towards the rear 26 of cooling unit 20 and thus closer to spray jet 44.

Figure 3:
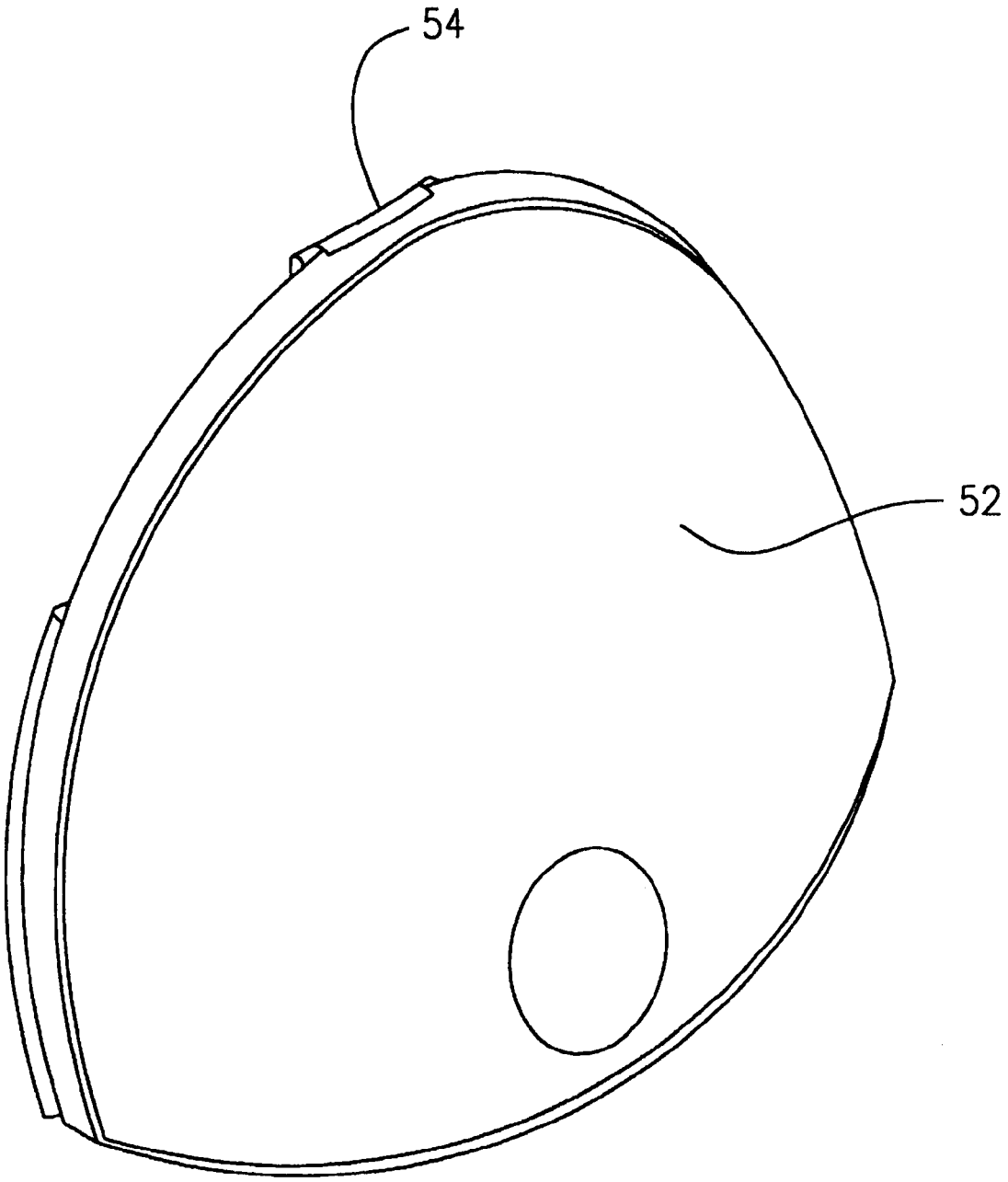
FIG. 3 is a perspective view of an embodiment of a splash guard according to the invention.
Figure 4:
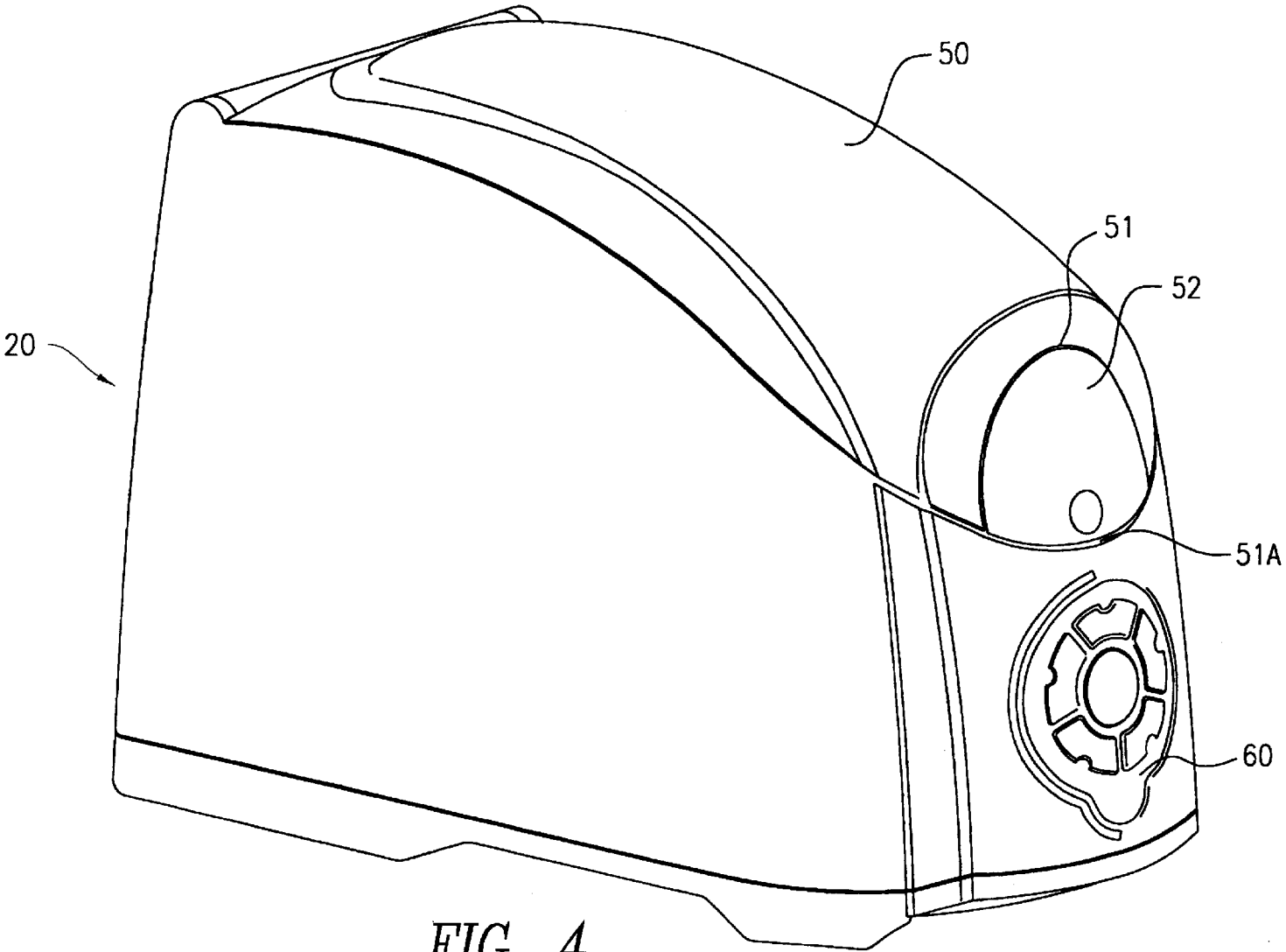
FIG. 4 is a right perspective view of the embodiment of FIG. 2 with the lid closed and the splash guard in place.

Unit 20 is preferably provided with a lid 50 to cover the device during operation so as to minimize splashing and provide an improved aesthetic appearance. Lid 50 preferably has a cut-out 51 and housing 22 is preferably provided with a cut-out or lip 51A in its front section. Cut-out 51 is provided to accommodate the necks of bottles which would otherwise not fit within the confines of housing 22. The cooling unit thus need not be dimensioned to surround an entire beer bottle or a wine bottle, since the neck portion is allowed to stick outside of housing 22 during use, resting on lip 51A. As shown in FIGS. 3 and 4, a removable splash guard is provided to cover cut-out 51 so as to minimize the amount of cooling medium that splashes out of the device during operation when a container fits entirely within housing 22. Splash guard 52 is preferably provided with tabs 54 which mate with slots (not shown) formed in lid 50 to retain the splash guard on the end of lid 50 in a removable fashion.

FIG. 4 also depicts a control panel 60 placed in a convenient location outside housing 22. The longer a container is rotated and sprayed, the cooler the contents become. Accordingly, settings such as "chilled", "cold", and "ice-cold" can be selected on the control panel as described below to provide the user with an idea of how cold he/she can make the fluid inside the container. As a simpler alternative, a basic on-off switch may be provided instead of a timing switch.

The operation of this embodiment of the invention is as follows. Ice is added to reservoir 32 of cooling unit 20, and then water added to reservoir 32. Next, container 10 is placed in cooling unit 20. Can 10 rests on support rings 36 of roller 34 and against ribs 38 projecting from at least one of the side walls of housing 22. Ribs 38 are angled and cause can 10 to sit on roller 34 askew from the axis of the roller by an angle. Finally, the user selects a button from control panel 60 (or an on-off switch) to activate the device. Roller 34 begins to rotate in this embodiment, which causes can 10 to rotate in the opposite direction as depicted by arrow A. The angle of can 10 with respect to the axis of rotation of roller 34 causes can 10 to migrate in the direction of arrow B towards spray jet 44. As can 10 rotates, the impinging water jet from spray jet 44 hits the can and is directed by the rotation of the can to coat the can with a thin film heat transfer layer of constantly replenished water at approximately 0° C. At the same time, agitated fluid within the cans presents an extended surface area to the heat transfer effects of the cooling water. The water thereafter falls off of can 10 and drains into the ice water reservoir 32 so that it may be re-cooled to 0° C. and be re-sprayed onto the container. No special suction cups, chambers, or other holding devices are required to keep the container in place for the requisite rotations. The clear advantage of the simple roller and ribs configuration is that the device may accommodate containers of significantly different geometries and sizes.

Figure 8B:
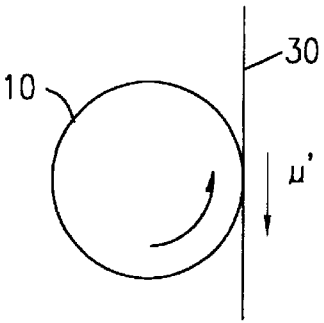
FIGS. 8A–B are schematics of the normal frictional forces created during rotation of a container against a wall.
Figure 8A:
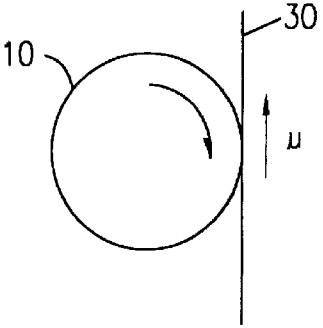

The geometry of the unit plays an important part in the how the device functions. As shown in FIGS. 8A–B, the container can either rotate in a clockwise direction (FIG. 8A) or a counterclockwise direction (FIG. 8B) with respect to the right wall. In either case, rotation in either direction will still carry out the invention. The distance from the ribs to the roller, the direction of the rotation of the motor, and the angle of the profile of the ribs with respect to the roller, are all variables used to control the positioning of the container. One roller can be used to chill two containers on opposite sides (assuming that the dimensions of the containers and the housing allow), and the length of the roller can increase the amount of containers being chilled, as will be discussed below.

Figure 5A:
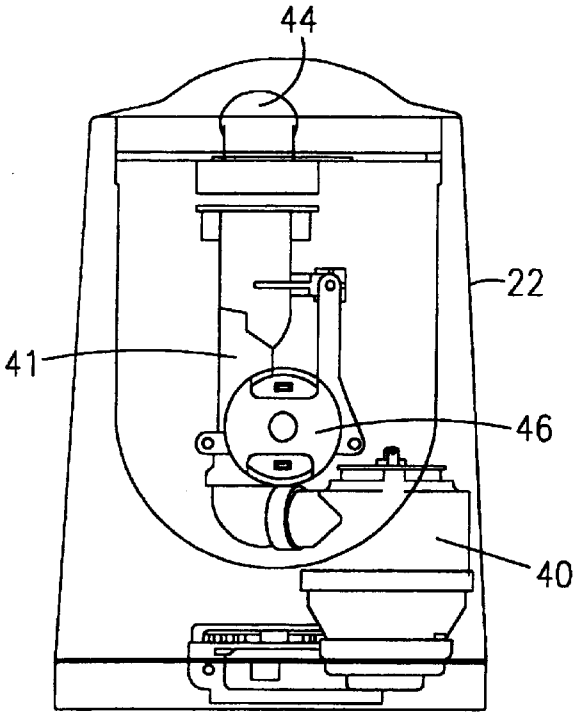

As shown in FIGS. 5A and B, roller 34 is rotated by motor 44 in a direct drive configuration. It is also possible to use gearing between the motor and the roller, however the unit operates more quietly and fails less often using a direct drive configuration.

Figure 6:
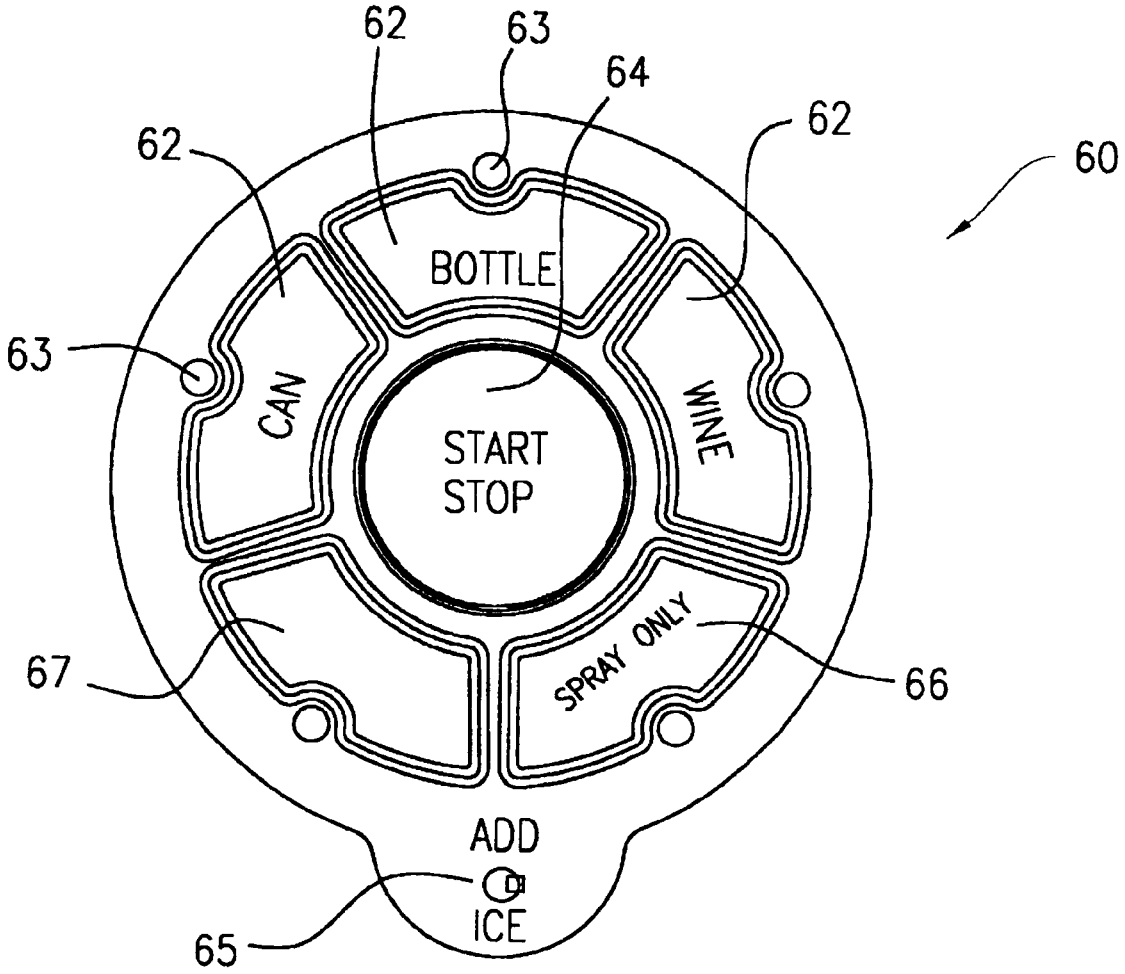
FIG. 6 is a schematic of an embodiment of a control panel for the invention.
Figure 7A:
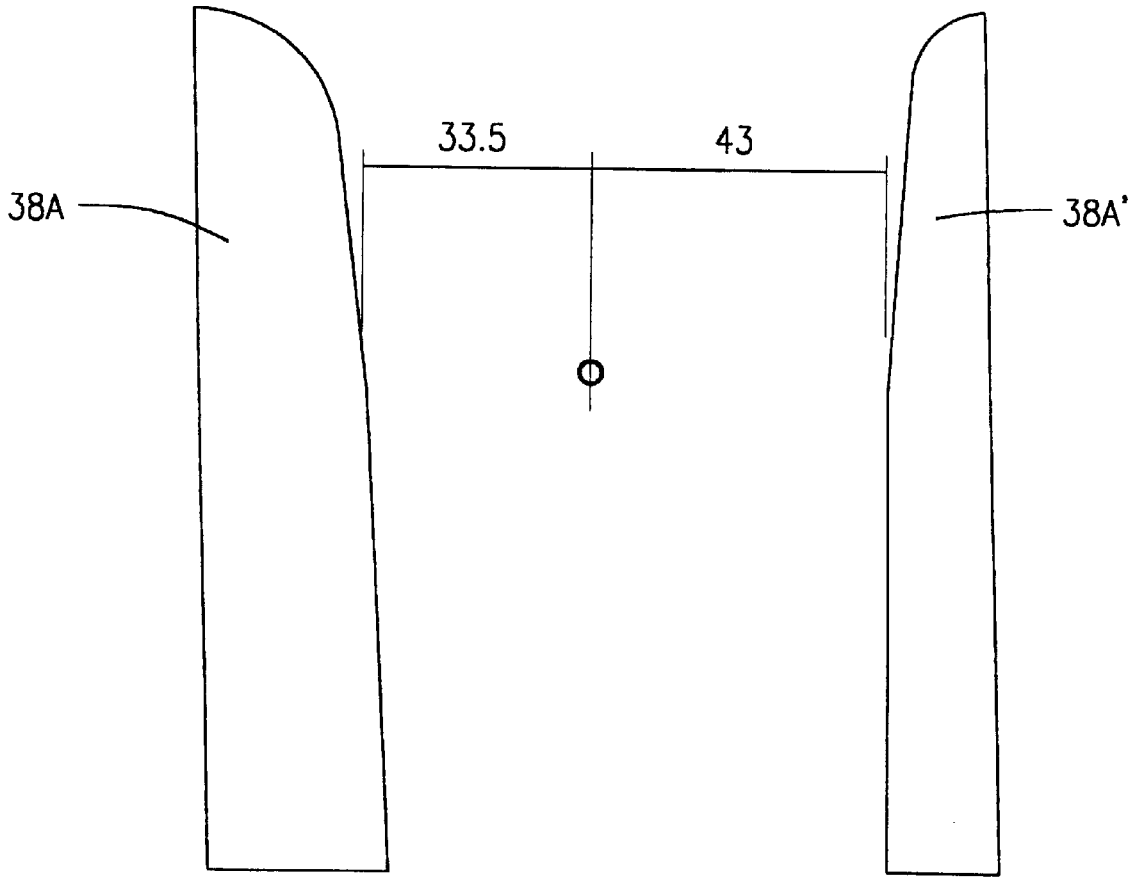
FIGS. 7A–D are a series of front view schematics of a preferred rib design for the invention.
Figure 7B:
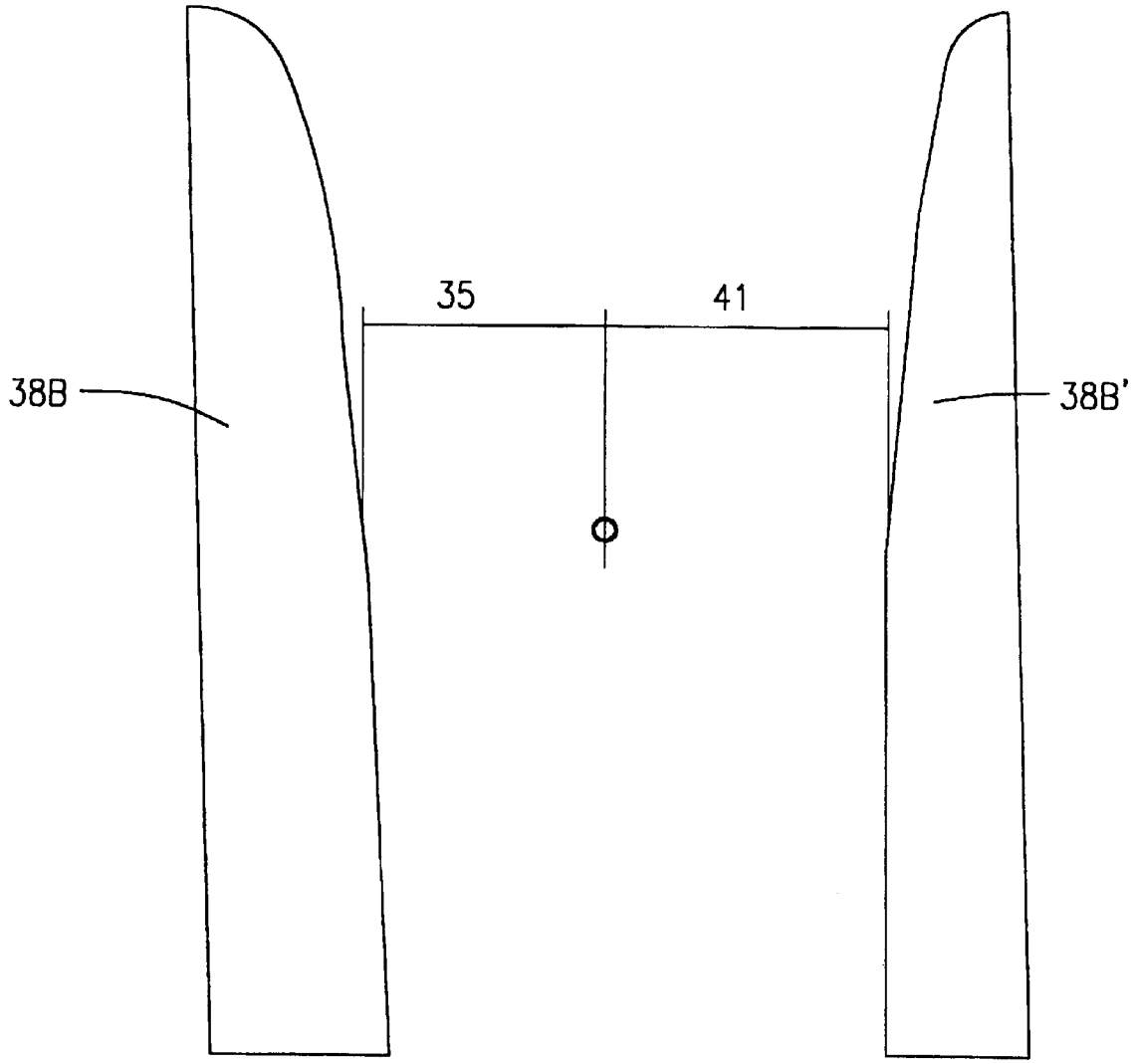
Figure 7C:
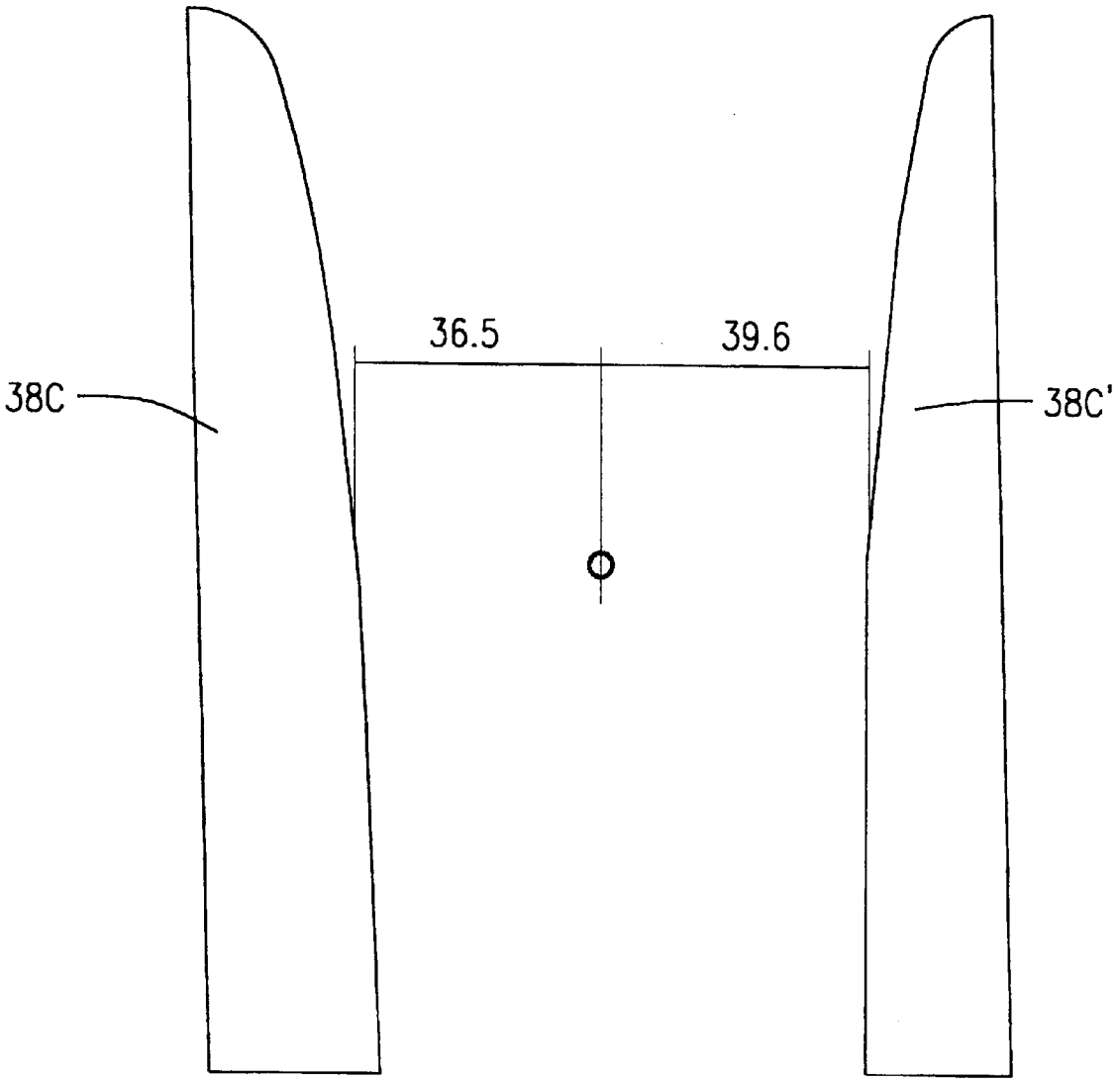
Figure 7D:
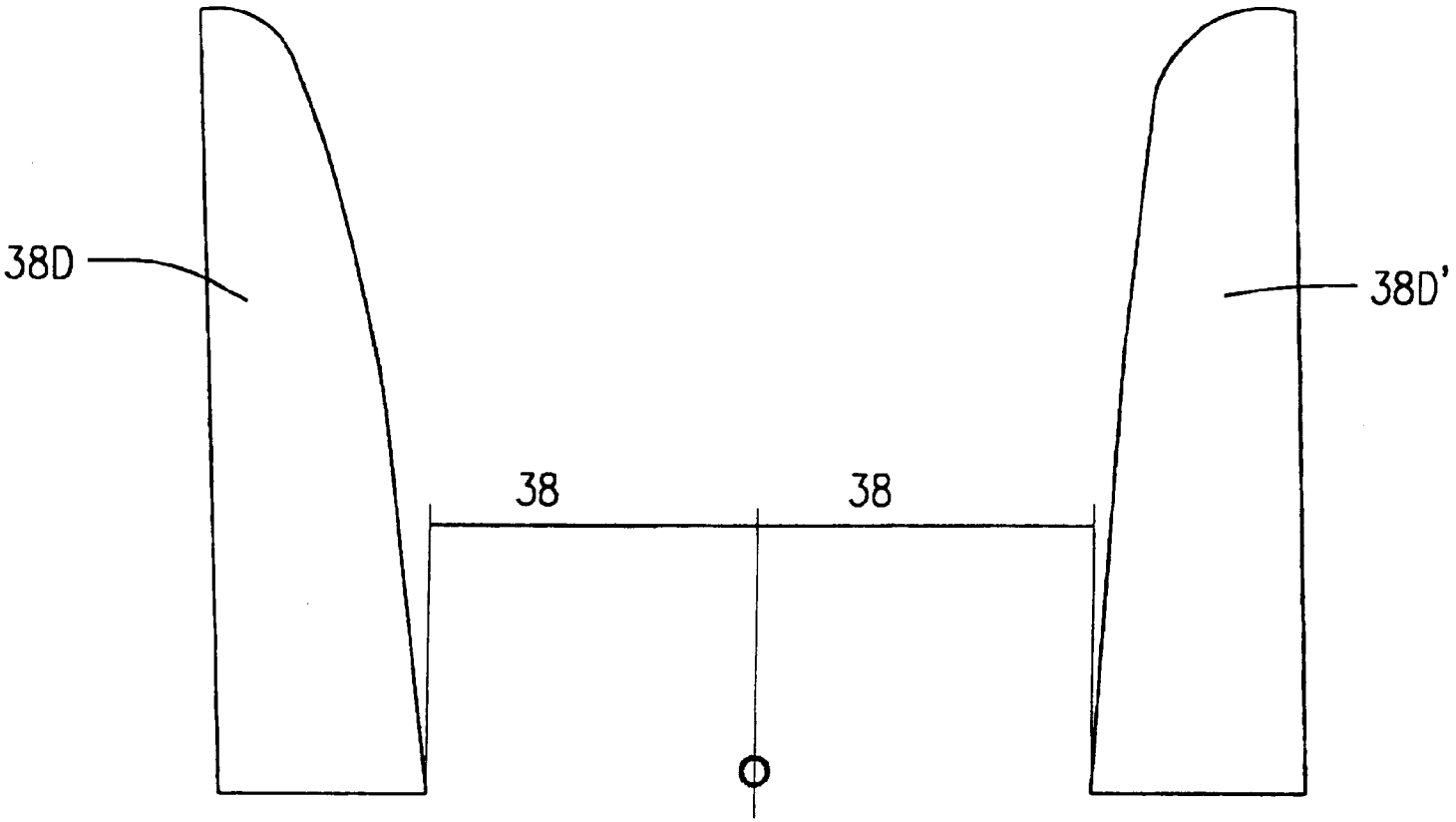

FIG. 6 depicts a preferred embodiment of the control panel 60. User interface 60 includes several container selector buttons 62 and an on-off button 64. The user determines which container he/she is going to be chilling and depresses the appropriate button 62. The user then presses the start button 64 to begin the chilling cycle. LEDs 63 indicate which chilling cycle has been selected and whether the device is on or off. A computer chip (not shown) or a mechanical timing mechanism (also not shown) may be connected to the container selector buttons 62 which will provide the proper length of chilling cycle for the desired container. In a more advanced embodiment, the selector buttons 62 may also change the volumetric flow rate of the water coming out of the spray jet and/or the speed of rotation of the roller (and thus the speed of rotation of the container); such parameters may be pre-programmed on a computer chip, a programmable logic controller, or the like.

In the preferred interface 60 of FIG. 6, the user is also provided with two additional cooling options. The first is a "spray only" button 66. This feature disables the rotation aspect of the process; roller 34 will not rotate, but spray jet 44 will coat the container with ice-cold water from the reservoir. The "spray only" option allows for the cooling of non-cylindrical containers that would not necessarily rotate smoothly over roller 34. Also, certain carbonated beverages (e.g., Guinness Stout and Murphy's Stout) are sold in containers having a diaphragm built into the container. The agitation of such a container via rotation may cause the product to fizz over when opened. A consumer may wish to chill champagne via the "spray only" method; champagne is notoriously explosive when disturbed or agitated. A cooling cycle having spraying without rotating will take somewhat longer than a spraying and rotating cooling cycle, however the fluid will still be cooled quicker than by conventional means.

A second feature enabled by user interface 60 is the "extra cold" button 67. By depressing this button in conjunction with any of the container selector buttons 62, the cooling cycle is extended by a predetermined period of time, depending on which container was selected. This will cool the beverage beyond the initial set point of, for example, 5° C. and bring it down to a lower temperature of, for example, 1 or 2° C.

Through use of the cooling unit of the invention, eventually all of the ice will melt and the cooling medium in reservoir 32 will begin to heat up. The user interface may preferably include an indicator 65 which informs the user that the ice-water solution is no longer at an optimal temperature. A temperature sensing device, such as a thermocouple, may be disposed in the housing in thermal communication with the reservoir 32. The temperature sensor may be disposed in reservoir 32 or in or near spray jet 44, or anywhere else that is convenient in the cooling medium flow path. When the cooling medium temperature rises above a certain point, for example, 3° C., the "Add Ice/Remove Water" indicator 65 is lighted to inform the user that the solution needs replenishing.

Another feature includes sensing or detecting the temperature of the container itself. This is helpful in determining when a liquid is properly cooled, so that the cooling unit may be deactivated when the set point temperature is reached. A temperature sensor may be provided in or on roller 34 in contact with the container being cooled for a direct contact measurement of the container's temperature. Alternatively, an infrared sensor may be disposed in the interior of housing 22 to visually detect the temperature of the container. An infrared detector might be disposed, for example, on an underside of lid 50 so that it would not be in contact with the cooling medium.

FIGS. 7A–D illustrates a preferred rib system for the invention. As shown, the cooling unit is provided with graduated ribs on both sides of the housing. Each of FIGS. 7A–D is a head-on or front view of each pair of ribs; it is not a top view of the ribs. On the left side, ribs 38A–D become progressively narrower as one approaches the rear 26 of the housing. On the right side, ribs 38A'–D' become progressively wider as one approaches rear 26 of the housing. As mentioned, the right-side ribs 38A'–D' have a profile skewed from the axis of roller 34. The left side ribs 38A–D have a profile which is also skewed from the axis of roller 34. By providing two sets of ribs on either side of a container, the container is held in an extremely stable fashion while it is being rotated, and the movement of the container towards the rear of the housing, regardless of which side wall the container rests, towards the spray jet is better ensured. The preferred angle for the rib profiles is between 0 and 15 degrees from the axis of the roller. The respective left and right rib profiles need not be precisely parallel to each other, but they should "tilt" in the same general direction. The preferred clearance between the ribs should be sufficient to accommodate a wide variety of containers. Larger containers may fit snugly against both sets of ribs, while smaller container may spin only against one wall, with the second wall possibly acting as a guide during longitudinal movement.

The ribs also serve to strengthen and reinforce the side walls; it is thus desirable to strengthen both side walls as opposed to merely one side wall. The ribs, as mentioned above, allow a person to obtain a better grip on the container when attempting to extract it from the cooling unit; providing ribs on both sides of the device accommodates both left-handed and right-handed people. The ribs have an aesthetic appeal as well.

One preferred embodiment of the invention includes a reservoir having a 1.5 L capacity. Such a reservoir is capable of receiving roughly 2 trays of ice cubes and 350 ml of water, sufficient ice water to cool six 12 oz cans of soda or beer fully within an hour of adding the ice and water to the device. The spray jet may be provided anywhere with respect to the axis of the container. The flow rate of water in the preferred embodiment of the invention is 10 to 15 L/min per 12 oz. container. Any flow rate between 5 and 100 L/min is acceptable for a tabletop domestic unit, however it has been determined that 100 L/min provides the greatest cooling effect per dollar spent on materials. In other words, while a 100 L/min pump would provide more cooling, the most cost-efficient flow rate is approximately 10 L/min for the domestic tabletop version of the invention.

Figure 9B:
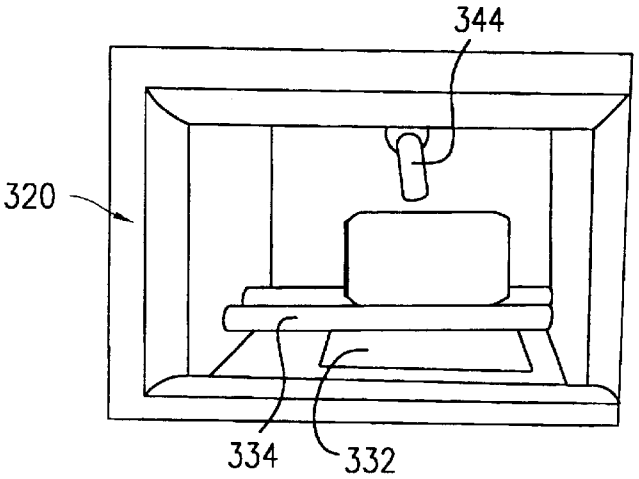
FIGS. 9A–B is a schematic of an alternate embodiment of the invention.
Figure 9A:
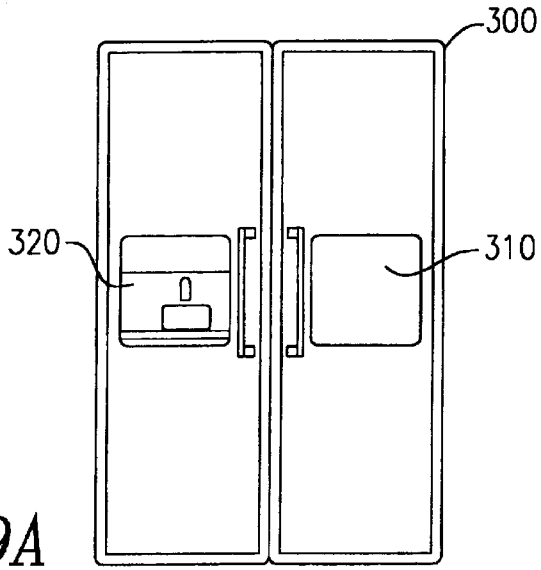

The invention is not limited to the above description. For example, the invention describes the container as being placed horizontally within the housing of the device. However, the container may be placeable at an angle to the horizontal and still be within the scope of the invention. One way this could be accomplished is by the angling of the roller away from the horizontal. The container may be at an angle of as much as 45° and still be within the scope of the invention. The angling of the container allows for certain open containers to be chilled with the inventive process, e.g., open bottles of wine. It would be recommended that the bottle be recorked prior to chilling, however recorking may not be required. The pump and motor are electrically interconnected with a computer controller which is preprogrammed with time parameters for cooling of the cans based on the desired temperature, can material and size of the can, with information entered via a keyboard. In other embodiments, such parameters can be readily written into EPROM for dedicated microprocessor control. At the appropriate cooling time, the pumps and motor stop and the beverage cans can then be removed from the device. Also, the inventive cooling unit is shown as a stand-alone device; however, the cooling unit may be incorporated into the door of a refrigerator or freezer as shown in FIGS. 9A–B. Refrigerator 300 may be provided with a conventional ice maker 310 recessed in the front of the unit and may be provided with a beverage chiller 320 in accordance with the present invention. As shown in FIG. 9B, chiller 320 includes an ice water reservoir 332, a roller 334, and a spray jet 344, all substantially similar to their respective counterparts described in the aforementioned embodiments.

Figure 10:
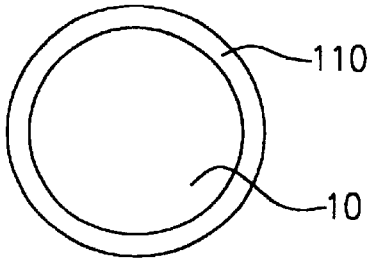
FIG. 10 is an end view schematic of a shield or sleeve for use with the invention.

Also, the invention is described as providing a thin film of cooling medium by spraying ice-cold water onto a container. Several variations are possible and contemplated as part of the invention. First, a shield may be provided to surround the container prior to it being sprayed by cooling medium so that the container itself does not get wet but is still cooled. As shown in FIG. 10, a shield or sleeve 110 can be disposed around container 10 to shield the container from direct contact with the cooling medium. Shield 110 may be rigid and dimensioned to fit snugly around container 10; a set of different-sized shields may be provided with cooling unit 20 to accommodate different sizes of containers (e.g., soda can, beer bottle, etc.). Alternatively, shield 110 may be flexible and elastic and be stretchable around any container of any size. In either case, the shield is preferably made from a material which is a good thermal conductor and is in snug contact with the container so that the thermal effects of the cooling medium contacting the shield are transmitted to the container and thence to the liquid inside.

Figure 11:
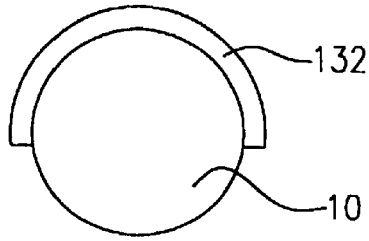
FIG. 11 is an end view schematic of an alternative means of supplying a thin film of cooling medium onto the container.
Figure 12:
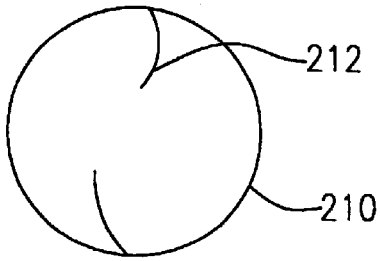
FIG. 12 is a sectional view schematic of a special container for use with the invention in making ice cream.
Figure 13:
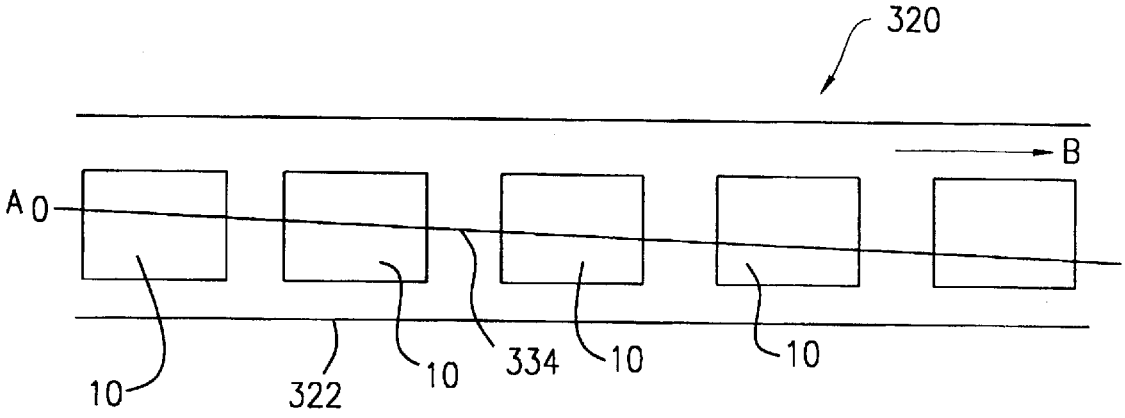
FIG. 13 is an alternative embodiment of the invention which can accommodate multiple containers and can preferably transport them during cooling.

Another alternative is shown in FIG. 11. Instead of providing a pump-driven spray jet to provide the thin film of cooling medium, A piece or pieces of ice or other cooling substance 132 may be provided in direct contact with container 10 (and/or with shield 110) while the container is rotated. The warmer container causes the ice 132 to melt, thereby providing a thin film of ice-cold water which will surround the container owing to gravity and rotation. The ice 132 is shown as an arcuate-shaped piece, however any shape and any number of pieces of ice are contemplated as a source of a thin film of cooling medium for the container. In this embodiment, instead of a reservoir, a drain may be provided to collect the runoff from ice 132 and remove it from use, rather than recycle it. This ice-drain alternative may be employed in the refrigerator door embodiment of FIG. 9.

Further, the invention is shown in the exemplary drawings as having a single-container capacity. However, larger embodiments which can accommodate multiple containers are also contemplated as being within the scope of the invention. As shown in schematic in FIG. 13, a cooling unit 320 is provided with a housing 322 and a roller 334 disposed at an angle to the housing walls. A number of containers 10 can be fed into cooling unit 320. Multiple spray jets may be provided. As roller 334 turns, containers 10 travel along the roller in the direction of arrow B, as described above. The result is that the device can not only cool multiple containers simultaneously or sequentially but transport them as well. Such an embodiment is ideal for a commercial setting, e.g., in a bar; warm drinks may be fed into the cooling unit 320 and by the time they emerge from the other side, they are cold and ready for consumption.

Also, the provision of ribs is preferred but not required. Instead, a smooth wall may be provided to support the rotating container laterally. The wall is preferably angled or curved to create the same corkscrew effect that is achieved by providing the graduated ribs of the preferred embodiment. Whether ribs or a smooth wall are employed, it is desirable to minimize the amount of friction between the container and the wall or free spinning rollers. Conversely, whether the roller employs contact rings or a smooth roller, it is desirable to maximize the friction between the roller and the container. The invention contemplates any materials which would achieve these goals.

The inventive method and device call be used to heat liquids instead without changing the structure or function of the device. Instead of adding ice water or another cooling medium to the reservoir, the user may add warm or hot tap water. The same steps of spraying and rotating will cause the liquid in the container to rapidly warm up. This method has excellent applications in warming baby bottles so that they do not become too hot (the current method of placing the bottle in a pot of water on a stove runs the risk of scalding the child). In another application, hospitals or trauma centers can rapidly warm or thaw refrigerated blood for use in a patient.

The invention is extremely flexible in use, and can not only be used to change the temperature of a liquid in a container but also to change the state of the liquid inside a container. For example, the invention can be used with a special container to make ice cream rapidly from the liquid components thereof. Instead of simply using water and ice, a solution of salt water—or any other fluid that can be cooled below 0° C. —can be employed as the cooling medium. In such an application, it is desired to cool the contents of the container below 0° C. A special container for making ice cream is shown in schematic section in FIG. 12. Container 210 is provided with one or more fins 212 projecting from an inner surface of the container. When the container is rotated, the contents slosh against fins 212 and are greatly agitated. This extra agitation is helpful in the forming of ice cream.

The cooling or warming medium to be used in the invention is not limited to water. Other fluids such as propylene glycol, alcohol, and the like, as well as chilled gases (e.g., very cold air, etc.), may be employed.

Having described the invention with regard to specific embodiments, it is to be understood that the above description is not meant as a limitation excluding such further variations or modifications as may be apparent or may suggest themselves to those skilled in the art. The invention is defined by the claims appearing hereinbelow.

What is claimed is:

1. A method of rapidly cooling a liquid in a container, the container having a longitudinal axis, comprising the steps of:

a) rapidly rotating the container about its longitudinal axis;

b) providing a source of a thin film of cooling medium to cool the container while performing said rotating step;

wherein said rotating step is performed at a rate dependent upon the geometry of the container.

2. A method of rapidly cooling a liquid in a container according to claim 1, said step b) comprising the step of spraying the container with the cooling medium from a spray source.

3. A method of rapidly cooling a liquid in a container according to claim 2, wherein said spraying step is performed to cover at least a majority of the surface area of the container with the cooling medium.

4. A method of rapidly cooling a liquid in a container according to claim 3, wherein said spraying step is performed from above the container.

5. A method of rapidly cooling a liquid in a container according to claim 2, further comprising the step of selectively disabling said rotating step so as to accommodate at least one of the geometry and the physical properties of the container.

6. A method of rapidly cooling a liquid in a container according to claim 2, further comprising the steps of:

setting a predetermined time period for said rotating and spraying steps; and automatically ceasing said rotating and spraying steps upon expiration of the predetermined time period.

7. A method of rapidly cooling a liquid in a container according to claim 1, further comprising the step of monitoring the temperature of at least one of the cooling medium and the liquid in the container.

8. A method of rapidly cooling a liquid in a container according to claim 1, wherein the liquid is a beverage and the container is a conventional beverage container.

9. A method of rapidly cooling a liquid in a container according to claim 1, further comprising the steps of:

providing a housing into which the container is disposed during said steps a) through c); and providing a hole in the housing, wherein a portion of the container is allowed to protrude from the housing via the hole during said steps a) through c).

10. A method of rapidly cooling a liquid in a container according to claim 9, further comprising the step of covering the hole in the housing to reduce splashing of the cooling medium during operation.

11. A method of rapidly cooling a liquid in a container according to claim 1, wherein the cooling medium is at least one of a liquid and a gas.

12. A method of rapidly cooling a liquid in a container according to claim 1, further comprising the step of shielding the container from direct physical contact with the cooling medium by providing a covering around the container in thermal communication with the container, wherein the cooling effects of the cooling medium pass through the covering and cool the liquid in the container.

13. A method of rapidly cooling a liquid in a container, the container having a longitudinal axis, comprising the steps of:

a) rapidly rotating the container about its longitudinal axis;

b) providing a source of a thin film of cooling medium to cool the container while performing said rotating step;

c) positioning the container at a first angle to the horizontal of less than 45°; and d) controlling the position of the container with respect to the thin film source, wherein said controlling step comprises the step of positioning the container at a second angle from a rotational axis of a rotating mechanism performing said rotating step and thereby urging the container to move along the rotating mechanism.

14. A method of rapidly cooling a liquid in a container, the container having a longitudinal axis, comprising the steps of:

a) rapidly rotating the container about its longitudinal axis;

b) providing a source of a thin film of cooling medium to cool the container while performing said rotating step, said step b) comprising the step of spraying the container with the cooling medium from a spray source;

c) setting a predetermined time period for said rotating and spraying steps; and d) automatically ceasing said rotating and spraying steps upon expiration of the predetermined time period;

e) overriding said automatic cessation step; and f) continuing to perform said spraying and rotating steps for a second predetermined period of time for extra cooling of the liquid in the container.

15. A method of rapidly cooling a liquid in a container, the container having a longitudinal axis, comprising the steps of:

a) rapidly rotating the container about its longitudinal axis;

b) providing a source of a thin film of cooling medium to cool the container while performing said rotating step;

c) collecting the cooling medium in a reservoir; and d) cooling the cooling medium with a cooling element in thermal communication with the reservoir.

16. A method of rapidly warming a liquid in a container, the container having a longitudinal axis, comprising the steps of:

rapidly rotating the container about its longitudinal axis;

spraying the container with a warming medium from a spray source while performing said rotating step;

wherein said rotating step is performed at a rate dependent upon the geometry of the container.

17. A method of rapidly warming a liquid in a container according to claim 16, wherein said spraying step is performed to cover at least a majority of the surface area of the container with the warming medium.

18. A method of rapidly warming a liquid in a container according to claim 17, wherein said spraying step is performed from above the container.

19. A method of rapidly warming a liquid in a container according to claim 16, further comprising the steps of:

setting a predetermined time period for said rotating and spraying steps; and automatically ceasing said rotating and spraying steps upon expiration of the predetermined time period.

20. A method of rapidly warming a liquid in a container according to claim 19, further comprising the step of selectively disabling said rotating step so as to accommodate at least one of the geometry and the physical properties of the container.

21. A method of rapidly warming a liquid in a container according to claim 19, further comprising the steps of:

overriding said automatic cessation step; and continuing to perform said spraying and rotating steps for a second predetermined period of time for extra warming of the liquid in the container.

22. A method of rapidly warming a liquid in a container according to claim 16, further comprising the step of monitoring the temperature of at least one of the warming medium and the liquid in the container.

23. A method of rapidly warming a liquid in a container according to claim 16, wherein the liquid is an infant beverage and the container is a conventional baby bottle.

24. A method of rapidly warming a liquid in a container according to claim 16, further comprising the steps of:

providing a housing into which the container is disposed during said rotating, spraying, and positioning steps; and providing a hole in the housing, wherein a portion of the container is allowed to protrude from the housing via the bole during said rotating, spraying, and positioning steps.

25. A method of rapidly warming a liquid in a container according to claim 24, further comprising the step of covering the hole in the housing to reduce splashing of the warming medium during operation.

26. A method of rapidly warming a liquid in a container according to claim 16, further comprising the step of shielding the container from direct physical contact with the warming medium by providing a covering around the container in thermal communication with the container, wherein the warming effects of the warming medium pass through the covering and heat the liquid in the container.

27. A method of rapidly warming a liquid in a container, the container having a longitudinal axis, comprising the steps of:

rapidly rotating the container about its longitudinal axis;

spraying the container with a warming medium from a spray source while performing said rotating step;

positioning the container at a first angle to the horizontal of less than 45°; and controlling the position of the container with respect to the spray source;

wherein said controlling step comprises the step of positioning the container at a second angle from a rotational axis of a rotating mechanism performing said rotating step and thereby urging the container to move along the rotating mechanism.

28. A method of rapidly warming a liquid in a container, the container having a longitudinal axis, comprising the steps of:

rapidly rotating the container about its longitudinal axis;

spraying the container with a warming medium from a spray source while performing said rotating step;

collecting the warming medium in a reservoir; and heating the warming medium with a heating element in thermal communication with the reservoir.

29. A method of rapidly making ice cream in a container, the container having a longitudinal axis, comprising the steps of:

a) rapidly rotating the container about its longitudinal axis;

b) providing a source of a thin film of a cooling medium having a temperature below 0° C. to cool the container while performing said rotating step;

c) positioning the container at a first angle to the horizontal of less than 45°; and d) controlling the position of the container with respect to the spray source, wherein said controlling step comprises the step of positioning the container at a second angle from a rotational axis of a rotating mechanism performing said rotating step and thereby urging the container to move along the rotating mechanism.

30. A method of rapidly making ice cream in a container according to claim 29, said step b) comprising the step of spraying the container with the cooling medium from a spray source.

31. A method of rapidly making ice cream in a container according to claim 30, wherein said spraying step is performed to cover at least a majority of the surface area of the container with the cooling medium.

32. A method of rapidly making ice cream in a container according to claim 30, wherein said spraying step is performed from above the container.

33. A method of rapidly making ice cream in a container according to claim 30, further comprising the steps of:

setting a predetermined time period for said rotating and spraying steps; and automatically ceasing said rotating and spraying steps upon expiration of the predetermined time period.

34. A method of rapidly making ice cream in a container according to claim 30, further comprising the step of shielding the container from direct physical contact with the cooling medium by providing a covering around the container in thermal communication with the container, wherein the cooling effects of the cooling medium pass through the covering and cool the liquid in the container.

35. A method of rapidly making ice cream in a container according to claim 29, further comprising the step of monitoring the temperature of at least one of the cooling medium and the liquid in the container.

36. A method of rapidly making ice cream in a container according to claim 29, wherein the cooling medium is at least one of a liquid and a gas.

37. A method of rapidly making ice cream in a container according to claim 29, further comprising the steps of:

collecting the cooling medium in a reservoir; and cooling the cooling medium with a cooling element in thermal communication with the reservoir.

38. A method of rapidly making ice cream in a container according to claim 29, further comprising the step of shielding the container from direct physical contact with the cooling medium by providing a covering around the container in thermal communication with the container, wherein the cooling effects of the cooling medium pass through the covering and cool the contents in the container.

39. A method of rapidly changing at least one of the temperature and the state of a liquid in a container, the container having a longitudinal axis, comprising the steps of:

a) rapidly rotating the container about its longitudinal axis;

b) providing a source of a thin film of a medium having a different temperature than the liquid in the container to thermally affect the container while performing said rotating step;

c) positioning the container at an angle to the horizontal of less than 45°; and d) passively controlling the position of the container with respect to the thin film source.

40. A method of rapidly changing at least one of the temperature and the state of a liquid in a container according to claim 39, wherein the medium is at least one of a liquid and a gas.

41. A method of rapidly changing at least one of the temperature and the state of a liquid in a container according to claim 39, laid step b) comprising the step of spraying the container with the medium from a spray source.

42. A method of rapidly changing at least one of the temperature and the state of a liquid in a container according to claim 41, further comprising the step of shielding the container from direct physical contact with the medium by providing a covering around the container in thermal communication with the container, wherein the thermal effects of the medium pass through the covering and change at least one of the temperature and the state of a liquid in a container.

43. A method of rapidly changing at least one of the temperature and the state of a liquid in a container according to claim 39, said step d) comprises the step of positioning the container at a second angle from a rotational axis of a rotating mechanism performing said rotating step and thereby urging the container to move along the rotating mechanism.

44. Apparatus for rapidly cooling a liquid in a container having a first longitudinal axis, comprising:

a housing having a bottom and side walls defining an interior volume;

a rotating mechanism having a second longitudinal axis disposed in said housing adapted to rotate a container placed in said interior volume about said first longitudinal axis;

a lateral positioner disposed at an angle to said second longitudinal axis in said housing adapted to position the container;

a spray jet spraying a cooling medium onto the container, wherein said lateral positioner causes the container to be at said angle to said second longitudinal axis.

45. Apparatus for rapidly cooling a liquid in a container according to claim 44, further comprising:

a reservoir in said interior volume adapted to contain a quantity of the cooling medium; and a pump in communication with said reservoir and said spray jet, wherein said pump draws the cooling medium from said reservoir and pumps it to said spray jet.

46. Apparatus for rapidly cooling a liquid in a container according to claim 45, wherein said lateral positioner and said rotating mechanism support the container within said interior volume out of contact with said reservoir.

47. Apparatus for rapidly cooling a liquid in a container according to claim 45, further comprising a support structure disposed within said interior volume adapted to support the container within said interior volume out of contact with said reservoir.

48. Apparatus for rapidly cooling a liquid in a container according to claim 45, wherein said lateral positioner and said rotating mechanism support the container within said interior volume in at least partial contact with said reservoir so that the container is at least partially submerged in said reservoir.

49. Apparatus for rapidly cooling a liquid in a container according to claim 45, further comprising a support structure disposed within said interior volume wherein said support structure supports the container within said interior volume in at least partial contact with said reservoir so that the container is at least partially submerged in said reservoir.

50. Apparatus for rapidly cooling a liquid in a container according to claim 45, said rotating mechanism including a roller, wherein the container is disposed on top of said roller when placed in said interior volume.

51. Apparatus for rapidly cooling a liquid in a container according to claim 50, wherein said lateral positioner supports the container from the side of the container and said roller supports the container from the bottom of the container when the container is disposed in said interior volume.

52. Apparatus for rapidly cooling a liquid in a container according to claim 51, wherein said lateral positioner and said roller support the container within said interior volume in a position that is one of i) out of contact with said reservoir and ii) in at least partial contact with said reservoir so that the container is at least partially submerged in said reservoir.

53. Apparatus for rapidly cooling a liquid in a container according to claim 51, further comprising a temperature monitor disposed in said interior volume measuring a temperature of at least one of the cooling medium and the liquid in the container.

54. Apparatus for rapidly cooling a liquid in a container according to claim 53, said temperature monitor being disposed in at least one of the following locations: said reservoir, said rotating mechanism, and an inner wall of said housing.

55. Apparatus for rapidly cooling a liquid in a container according to claim 51, said roller further comprising raised portions disposed along said roller, wherein when the container is placed on said roller, the container only contacts said raised portions.

56. Apparatus for rapidly cooling a liquid in a container according to claim 45, further comprising a timing circuit connected to and controlling said rotating mechanism and said pump, wherein said liming circuit automatically shuts off said rotating mechanism and said pump after a preset time period.

57. Apparatus for rapidly cooling a liquid in a container according to claim 56, wherein a user can select a duration of said preset time period from a control panel.

58. Apparatus for rapidly cooling a liquid in a container according to claim 56, further comprising a control mechanism in communication with said rotating mechanism and said pump which selectively extends said preset time period to thereby cool the liquid to a greater degree.

59. Apparatus for rapidly cooling a liquid in a container according to claim 45, further comprising a control mechanism in communication with said rotating mechanism and said pump which selectively activates said pump and does not activate said rotating mechanism.

60. Apparatus for rapidly cooling a liquid in a container according to claim 45, further comprising an active cooling unit in thermal communication with said reservoir.

61. Apparatus for rapidly cooling a liquid in a container according to claim 60, wherein said active cooling unit comprises refrigeration coils and a compressor.

62. Apparatus for rapidly cooling a liquid in a container according to claim 60, said active cooling unit comprising Peltier devices disposed in said housing in thermal communication with said reservoir.

63. Apparatus for rapidly cooling a liquid in a container according to claim 45, wherein said housing is a portion of a refrigerator, and wherein refrigeration coils and a compressor of the refrigerator actively cool the cooling medium in said reservoir.

64. Apparatus for rapidly cooling a liquid in a container according to claim 44, said lateral positioner comprising a plurality of ribs projecting inwardly from an inner surface of at least one of said walls.

65. Apparatus for rapidly cooling a liquid in a container according to claim 64, wherein a profile of said ribs is skewed with respect to said second longitudinal axis thereby urging the container to move along said rotating mechanism.

66. Apparatus for rapidly cooling a liquid in a container according to claim 65, wherein said ribs are spaced apart sufficiently to allow a user to insert fingers respectively between said ribs to retrieve or place the container in said interior volume.

67. Apparatus for rapidly cooling a liquid in a container according to claim 65, wherein said lateral positioner causes the container to move towards said spray jet when said rotating mechanism is rotating.

68. Apparatus for rapidly cooling a liquid in a container according to claim 44, said lateral positioner comprising an interior surface of one of said side walls, said interior surface being skewed with respect to said second longitudinal axis thereby urging the container to move along said rotating mechanism.

69. Apparatus for rapidly cooling a liquid in a container according to claim 44, further comprising a timing circuit connected to and controlling said rotating mechanism, wherein said timing circuit automatically shuts off said rotating mechanism after a preset time period.

70. Apparatus for rapidly cooling a liquid in a container according to claim 69, wherein a user can select a duration of said preset time period from a control panel.

71. Apparatus for rapidly cooling a liquid in a container according to claim 44, wherein said housing is a portion of a refrigerator.

72. Apparatus for rapidly cooling a liquid in a container according to claim 44, said housing further comprising a hole, wherein a portion of the container is allowed to protrude from said housing via said hole while said rotating mechanism and spray jet are operating.

73. Apparatus for rapidly cooling a liquid in a container according to claim 72, further comprising a removable splash guard attachable to said housing to cover said hole at least partially.

74. Apparatus for rapidly cooling a liquid in a container according to claim 44, wherein the liquid is a beverage and the container is a conventional beverage container.

75. Apparatus for rapidly cooling a liquid in a container according to claim 44, wherein said cooling medium is at least one of a liquid and a gas.

76. Apparatus for rapidly cooling a liquid in a container according to claim 44, further comprising:

a covering removably disposable around the container in thermal communication with the container shielding the container from direct contact with said cooling medium, wherein the cooling effects of the cooling medium pass through said covering and cool the liquid in the container.

77. Apparatus for rapidly cooling a liquid in a container according to claim 76, wherein said covering is elastic and when disposed around the container conforms to the container geometry allowing substantially no air gaps between said covering and the container.

78. Apparatus for rapidly cooling a liquid in a container according to claim 76, wherein said covering is rigid and is dimensioned to conform to a specific container so as to allow substantially no air gap between said covering and the container.

79. Apparatus for rapidly cooling a liquid in a container according to claim 78, said covering further comprising a plurality of rigid coverings each dimensioned to conform to a different specific container.

80. Apparatus for rapidly warming a liquid in a container according to claim 79, wherein said warming medium is at least one of a liquid and a gas.

81. Apparatus for rapidly warming a liquid in a container having a first longitudinal axis, comprising:

a housing having a bottom and side walls defining an interior volume;

a rotating mechanism having a second longitudinal axis disposed in said housing adapted to rotate a container placed in said interior volume about said first longitudinal axis;

a lateral positioner disposed at an angle to said second longitudinal axis in said housing adapted to position the container;

a spray jet spraying a warming medium onto the container, wherein said lateral positioner causes the container to be at an angle to said second longitudinal axis.

82. Apparatus for rapidly warming a liquid in a container according to claim 81, further comprising:

a reservoir in said interior volume adapted to contain a quantity of the warming medium; and a pump in communication with said reservoir and said spray jet, wherein said pump draws the warming medium from said reservoir and pumps it to said spray jet.

83. Apparatus for rapidly warming a liquid in a container according to claim 72, wherein said lateral positioner and said rotating mechanism support the container within said interior volume out of contact with said reservoir.

84. Apparatus for rapidly warming a liquid in a container according to claim 83, wherein the container is a conventional baby bottle, and wherein said lateral positioner causes the bottle to move towards said spray jet when said rotating mechanism is rotating.

85. Apparatus for rapidly warming a liquid in a container according to claim 82, wherein said lateral positioner and said rotating mechanism support the container within said interior volume in at least partial contact with said reservoir so that the container is at least partially submerged in said reservoir.

86. Apparatus for rapidly warming a liquid in a container according to claim 82, further comprising a support structure disposed within said interior volume wherein said support structure supports the container within said interior volume in at least partial contact with said reservoir so that the container is at least partially submerged in said reservoir.

87. Apparatus for rapidly warming a liquid in a container according to claim 82, further comprising a temperature monitor disposed in said interior volume measuring a temperature of at least one of the warming medium and the liquid in the container.

88. Apparatus for rapidly warming a liquid in a container according to claim 82, further comprising a timing circuit connected to and controlling said rotating mechanism and said pump, wherein said timing circuit automatically shuts off said rotating mechanism and said pump after a preset time period.

89. Apparatus for rapidly warming a liquid in a container according to claim 82, further comprising a control mechanism in communication with said rotating mechanism arid said pump which selectively activates said pump and does not activate said rotating mechanism.

90. Apparatus for rapidly warming a liquid in a container according to claim 82, further comprising an active warming unit in thermal communication with said reservoir.

91. Apparatus for rapidly warming a liquid in a container according to claim 90, said active warming unit comprising Peltier devices disposed in said housing in thermal communication with said reservoir.

92. Apparatus for rapidly warming a liquid in a container according to claim 81, said lateral positioner comprising a plurality of ribs projecting inwardly from an inner surface of at least one of said walls.

93. Apparatus for rapidly warming a liquid in a container according to claim 92, wherein a profile of said ribs is skewed with respect to said second longitudinal axis, thereby urging the container to move along said rotating mechanism.

94. Apparatus for rapidly warming a liquid in a container according to claim 93, wherein said ribs are spaced apart sufficiently to allow a user to insert fingers respectively between said ribs to retrieve or place the container in said interior volume.

95. Apparatus for rapidly warming a liquid in a container according to claim 81, said lateral positioner comprising an interior surface of one of said side walls, said interior surface being skewed with respect to said second longitudinal axis, thereby urging the container to move along said rotating mechanism.

96. Apparatus for rapidly warming a liquid in a container according to claim 81, further comprising a timing circuit connected to and controlling said rotating mechanism, wherein said timing circuit automatically shuts off said rotating mechanism after a preset time period.

97. Apparatus for rapidly warming a liquid in a container according to claim 81, further comprising:

a covering removably disposable around the container in thermal communication with the container shielding the container from direct contact with said warming medium, wherein the warming effects of the warming medium pass through said covering and warm the liquid in the container.

98. Apparatus for rapidly warming a liquid in a container according to claim 97, wherein said covering is elastic and when disposed around the container conforms to the container geometry allowing substantially no air gaps between said covering and the container.

99. Apparatus for rapidly warming a liquid in a container according to claim 97, wherein said covering is rigid and is dimensioned to conform to a specific container so as to allow substantially no air gap between said covering and the container.

100. Apparatus for rapidly making ice cream, comprising:

a container having a first longitudinal axis into which ice cream ingredients are disposable;

a housing having a bottom and side walls defining an interior volume into which said container is placed;

a rotating mechanism having a second longitudinal axis disposed in said housing adapted to rotate said container about said first longitudinal axis;

a lateral positioner disposed at an angle to said second longitudinal axis in said housing adapted to position said container; and a spray jet spraying a cooling medium having a temperature below 0° C. onto said container, wherein when said container is placed within said interior volume, said lateral positioner causes said container to be at an angle to said second longitudinal axis.

101. Apparatus for rapidly making ice cream according to claim 100, further comprising:

a reservoir in said interior volume adapted to contain a quantity of the cooling medium;

a pump in communication with said reservoir and said spray jet, wherein said pump draws the cooling medium from said reservoir and pumps it to said spray jet.

102. Apparatus for rapidly making ice cream according to claim 101, further comprising a timing circuit connected to and controlling said rotating mechanism and said pump, wherein said timing circuit automatically shuts off said rotating mechanism and said pump after a preset time period.

103. Apparatus for rapidly making ice cream according to claim 101, further comprising an active cooling unit in thermal communication with said reservoir.

104. Apparatus for rapidly making ice cream according to claim 103, wherein said active cooling unit comprises refrigeration coils and a compressor.

105. Apparatus for rapidly making ice cream according to claim 103, said active cooling unit comprising Peltier devices disposed in said housing in thermal communication with said reservoir.

106. Apparatus for rapidly making ice cream according to claim 100, said lateral positioner comprising a plurality of ribs projecting inwardly from an inner surface of at least one of said walls.

107. Apparatus for rapidly making ice cream according to claim 106, wherein a profile of said ribs is skewed with respect to said second longitudinal axis, thereby urging said container to move along said rotating mechanism.

108. Apparatus for rapidly making ice cream according to claim 100, said lateral positioner comprising an interior surface of one of said side walls, said interior surface being skewed with respect to said second longitudinal axis, thereby urging said container to move along said rotating mechanism.

109. Apparatus for rapidly making ice cream, according to claim 100, said container further comprising at least one fin projecting inwardly from an inner surface of said container, wherein when said container is rotated, said fin agitates the contents of said container to facilitate hardening of the contents into ice cream.

110. Apparatus for rapidly making ice cream according to claim 100, wherein said cooling medium is at least one of a liquid and a gas.

111. Apparatus for rapidly changing at least one of the temperature and the slate of a liquid in a container, comprising:

a housing having a bottom and side walls defining an interior volume;

a rotating mechanism having a longitudinal axis disposed in said housing adapted to rotate a container about the container's longitudinal axis;

a lateral positioner disposed at an angle to said longitudinal axis in said housing adapted to position the container; and a source of a thin film of a medium having a first temperature different from a second temperature of the liquid inside the container to thermally affect the container, wherein when the container is placed within said interior volume, said lateral positioner causes the container to be at an angle to said longitudinal axis.

112. Apparatus according to claim 111, said source of thin film comprising a spray jet spraying the medium towards the container.

113. Apparatus according to claim 112, further comprising:

a reservoir in said interior volume adapted to contain a quantity of the medium; and a pump in communication with said reservoir and said spray jet, wherein said pump draws the medium from said reservoir and pumps it to said spray jet.

114. Apparatus according to claim 113, further comprising a Peltier device in thermal communication with said reservoir, wherein when said apparatus is being used to cool the liquid, said Peltier device cools the medium in said reservoir, and when said apparatus is being used to warm the liquid, said Peltier device warms the medium in said reservoir.

115. Apparatus according to claim 113, further comprising an active cooling unit in thermal communication with said reservoir.

116. Apparatus according to claim 115, wherein said active cooling unit comprises refrigeration coils and a compressor.

117. Apparatus according to claim 112, wherein said lateral positioner causes said container to move towards said spray jet when said rotating mechanism is rotating.

118. Apparatus according to claim 111, source of thin film comprising at least one piece of ice disposed above the container in contact with the container, wherein as said ice melts, said ice creates a thin film of cold water which cools the container.

119. Apparatus according to claim 111, further comprising:

a covering removably disposable around the container in thermal communication with the container shielding the container from direct contact with the medium, wherein the thermal effects of the medium pass through said covering and change at least one of the temperature and the state of the liquid in the container.

120. Apparatus according to claim 111, wherein said housing is a portion of a refrigerator.

121. Apparatus according to claim 120, wherein said source of thin film comprises at least one piece of ice disposed above the container in contact with the container, wherein as said ice melts, said ice creates a thin film of cold water which cools the container.

122. Apparatus for rapidly cooling a liquid in a container, comprising:

a housing having a bottom and side walls defining an interior volume, said housing being part of a refrigerator;

a rotating mechanism having a longitudinal axis disposed in said housing adapted to rotate a container about the container's longitudinal axis;

a source of a thin film of a cooling medium to cool the container, wherein when the container is placed within said interior volume, the thin film of cooling medium thermally communicates with the container while said rotating mechanism rotates the container, wherein said thin film source comprises at least one of a spray jet directing the cooling medium towards the container and a piece of ice disposed above the container in contact with the container, said ice forming a thin film of cold water as said ice melts and cools the liquid in the container.

* * * * *